US008166576B2

(12) United States Patent
Kato

(10) Patent No.: US 8,166,576 B2
(45) Date of Patent: May 1, 2012

(54) OPENING/CLOSING DEVICE AND HELMET HAVING THE SAME

(75) Inventor: Hideo Kato, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 430 days.

(21) Appl. No.: 12/436,985

(22) Filed: May 7, 2009

(65) Prior Publication Data

US 2009/0288242 A1 Nov. 26, 2009

(30) Foreign Application Priority Data

May 21, 2008 (JP) ..... 2008-133240
Oct. 14, 2008 (JP) ..... 2008-265725

(51) Int. Cl.
*A42B 1/08* (2006.01)

(52) U.S. Cl. ..... 2/424

(58) Field of Classification Search ..... 2/9, 6.5, 2/424, 425
See application file for complete search history.

(56) References Cited

U.S. PATENT DOCUMENTS 5,062,162 A * 11/1991 Kamata ..... 2/424
5,185,889 A * 2/1993 Kamata ..... 2/424
5,461,731 A * 10/1995 Shida ..... 2/424
5,901,369 A * 5/1999 Pilney ..... 2/6.5
6,260,213 B1 * 7/2001 Eom et al. ..... 2/424
6,301,721 B1 * 10/2001 Arai ..... 2/424
6,654,969 B2 * 12/2003 Taniuchi ..... 2/424
6,711,753 B2 * 3/2004 Arai ..... 2/424
6,732,380 B1 * 5/2004 Lee ..... 2/424
6,851,129 B2 * 2/2005 Gafforio et al. ..... 2/424
7,065,798 B2 * 6/2006 Kuo ..... 2/424
7,181,777 B2 * 2/2007 Choi et al. ..... 2/424
7,210,174 B2 * 5/2007 Yeh ..... 2/424
7,398,561 B2 * 7/2008 Kim et al. ..... 2/424

FOREIGN PATENT DOCUMENTS

JP 2541873 4/1997

* cited by examiner

*Primary Examiner* — Danny Worrell, Jr.
(74) *Attorney, Agent, or Firm* — Notaro, Michalos & Zaccaria P.C.

(57) ABSTRACT

An opening/closing device for openably/closably supports an opening/closing part with regard to an opened/closed part, and the opening/closing device is characterized in that it comprises an attaching part attached to the opened/closed part so as to rotate around a rotation axis together with the opening/closing part, a rotation part rotatably attached to an attaching portion extending from a rotation center of the attaching part and engaged with the opened/closed part, and a friction torque generation means provided between the attaching portion of the attaching part and the rotation part, as well as in that the opening/closing device is so configured that it can bring the opening/closing part to stop using free-stop function, when the opening/closing part is opened and closed with regard to the opened/closed part.

13 Claims, 22 Drawing Sheets

(a)

(b)

(A)

(B)

(A)

(B)

(A)

(B)

(C)

OPENING/CLOSING DEVICE AND HELMET HAVING THE SAME

FIELD OF THE INVENTION

The present invention relates to an opening/closing device suitable in use for opening and closing an opening/closing member with regard to an opened/closed member using free-stop function, and a helmet equipped with such an opening/closing device.

BACKGROUND ART

The present invention relates to an opening/closing device suitable in use for supporting an opening/closing member such as a shield in opening and closing with regard to an opened/closed member such as a helmet body, so that the above-mentioned opening/closing member can stop at any opening/closing position as well as a helmet equipped with such an opening/closing device.

For example as a helmet, the one equipped with a helmet body having an opening portion on a front surface and a shield for opening and closing the opening portion is commonly known, wherein the shield is opened and closed with regard to the helmet body using opening/closing devices in such a manner that the shield can stop at any position. In this helmet, end portions of the shield are rotatably jointed via the opening/closing devices to side portions of the helmet body, and thus the opening can be covered or exposed as appropriate.

As opening/closing devices of this type, the ones have been already proposed in JP Utility Model Registration No. 2541873, wherein the opening/closing devices support a shield so as to be openable/closable with regard to a helmet body, and generate a friction torque between the helmet body and the shield in an opening/closing direction so that the shield can be opened/closed with regard to the helmet body so as to stop at any opening/closing position.

Opening/closing devices as disclosed in the commonly known document are equipped with guide members provided on both side portions of a helmet body for openably/closably supporting both end portions of a shield and friction torque generation means which generate a friction torque between the helmet body and the shield, which forces the shield to stop at any opening/closing position. The friction torque generation means here generates a friction torque around a respective axis of shaft bodies which pivotally support the shield so as to be openable/closable with regard to the helmet body, and in this manner enable a stop of the shield at any opened/closed position with regard to the helmet body.

Nevertheless, in friction torque generation means which, as are the case with opening/closing devices disclosed in the above-mentioned commonly known document, generate a friction torque around a respective axis of shaft bodies, a sufficient rotational resistance cannot always be generated, which can cause the shield once opened to slip off. If one wishes to obtain a friction torque necessary to avoid this, a large friction area will be necessary, which leads to a problem of an increase in size of opening/closing devices.

On the other hand, if opening/closing devices are so designed that positions for friction generation are located at points radially distant from respective centers of rotation of a shield, the devices are of simple structure, and enable, even in a small size, to ensure a great rotational resistance. However, if for example groove portions in a shape of circle which is large (in radius) are formed on the shield itself for the above-mentioned purpose, problems arise in that the grooves in a shape of circle are hindrance to vision or factors unfavorable in terms of strength (factors such as those facilitating the generation of cracks).

On the other hand, opening/closing devices, even in a small size, requiring a large friction torque are also needed, except for a helmet, in opening/closing a first casing as opened/closed member provided with an operation portion, and a second casing as opening/closing member provided with a display device, the both casings being of a small-sized portable equipment such as a portable phone, a PDA and a notebook PC.

SUMMARY OF THE INVENTION

The present invention is made to solve the above-mentioned problems, and an object of the invention is to provide opening/closing devices which, even of a small size, can generate a large friction torque so that opening/closing members can stably stop at any opening/closing position, are compact and do not require a space for mounting, as well as a helmet or a portable equipment equipped with the above-mentioned opening/closing devices.

To achieve the above-mentioned object, the opening/closing devices according to the present invention are characterized in that the opening/closing device support an opening/closing member so as to be openable/closable with regard to an opened/closed member; in the opening/closing device a friction torque generation means is provided between the opened/closed members distanced from the guide member and the opening/closing member; that the friction torque generation means is equipped with an attaching member attached to the opened/closed member and with rotating members rotatably attached to the attaching member and engaged with the opened/closed member as well, and the friction torque generation means are so designed that they generate a friction torque between the attaching member and the rotating member so that the opening/closing member can stop with regard to opened/closed member using free-stop function.

In accordance with the above-mentioned invention, friction torque generation means as elements independent from opening/closing member are provided at positions away from guide member supporting the opening/closing member so as to be openable/closable with regard to opened/closed member and so designed that the friction torque generation means generate a friction torque when the opening/closing member stop with regard to opened/closed member, so that a rotational torque as generated in rotating the opening/closing member with regard to the opened/closed member around the guide member as axes is large even though the friction torque as generated between the attaching member and the rotating member, both being components of the friction torque generation means is small. Therefore, the friction torque generation means, even of a small size, can realize a satisfactory stop of the opening/closing member with regard to the opened/closed member using free-stop function.

An opening/closing devices which respectively supports both end portions of an opening/closing member shield so as to be openable/closable with regard to an opened/closed member helmet body being a constituent part of a helmet is characterized in that the opened/closed member helmet body provided at least on the side of one end portion comprises a cover portion having a bearing portion and fixed to the opened/closed member helmet body, an attaching member borne by the bearing portion of the cover portion and attached to the opening/closing member shield so as to be rotatable together with the opening/closing member shield, a fixing arm coaxially attached to the attaching member and fixed to the opened/closed member helmet body, a torque pin attached at a position away from an attaching center of the fixing arm and inserted into a guide groove located at a position away from a rotational center of the attaching member, and a friction torque generation means comprising a friction washer accommodating the torque pin into its central portion and provided between the attaching member and an elastic member.

In the opening/closing device according to the present invention it is preferable that the friction torque generation means is equipped with an attaching member having a rotation supporting portion in the shape of ring rotatably supported on the guide member and an attaching portion protruding from an outer circumference of the rotation supporting portion, with a torque pin rotatably or fixedly attached to the attaching portion of the attaching member, with a rotation member attached to the torque pin so as to be rotatable together with the torque pin or rotatably attached around the axis of the torque pin and an elastic member provided on the torque pin for generating a friction torque between the attaching member and the rotation member. Moreover, in the opening/closing device according to the present invention it is preferable that the friction torque generation means is equipped with an attaching member having a rotation supporting portion in the shape of ring rotatably supported on the guide member and an attaching portion protruding from an outer circumference of the rotation supporting portion, with a torque pin rotatably or fixedly attached to the attaching portion of the attaching member, with a rotation member attached to the torque pin so as to be rotatable together with the torque pin or rotatably attached around the axis of the torque pin, a torque member attached on an outer circumference of the torque pin between the rotation member and the attaching member, so as to be rotatable together with the torque pin and movable in an axial direction of the torque pin, and an elastic member provided on the torque pin for pushing the torque member toward the attaching portion and generating a friction torque between the attaching member and the rotation member.

Moreover, the present invention aims at solving the above-mentioned problem by an opening/closing device which is so designed that it comprises a rotation member fixed to a side of the opening/closing member shield, an attaching member to which the rotation member is attached so as to be rotatable with regard to the opened/closed member helmet body, and a friction torque generation means provided between the rotation member and the opened/closed member helmet body, wherein the friction torque generation means comprises a guide groove provided at a position away from a rotation center of the rotation member and a friction means fitted into the guide groove so as to be frictionally movable.

In this case, in the present invention it is possible that the friction means comprises a fixing pin attached to a side of the opened/closed member helmet body, an arm member fixed between the fixing pin and the attaching member, and a torque pin attached to the arm member.

Furthermore, in the present invention it is possible that the friction means is a torque pin attached to the side of the opened/closed member helmet body.

Still further, in the present invention it is possible that the friction means comprises an attaching pin attached to the side of the opened/closed member helmet body and a cylindrical portion fitted onto an outer circumference of the attaching pin.

Still further, in the present invention it is characterized in that, when fitting the cylindrical portion onto the attaching pin, the cylindrical portion is fixed onto the attaching pin.

Still further, in the present invention it is characterized in that when fitting the torque pin into the guide groove, either one side or both sides of the torque pin are brought into press contact with an inner side of the guide groove.

Still further, in the present invention it is possible that a click stop means via a concave portion or a convex portion is provided between the guide groove and the torque pin.

Still further, in the present invention it is possible that a stopper means is provided between the opening/closing member shield and the opened/closed member helmet body for forcing the opening/closing member to stop at fully closed position or fully opened position with regard to the opened/closed member helmet body.

Still further, in the present invention it is characterized in that the opened/closed member is a helmet body or a first casing of a portable equipment and that the opening/closing member is a shield or a second casing of a portable equipment.

Still further, in the present invention it is characterized in that a helmet according to the present invention is equipped with the opening/closing device according to the present invention.

As described in the foregoing, in accordance with the opening/closing device and the helmet according to the present invention, a friction torque generation means is provided between the opened/closed member away from a guide member and the opening/closing member shield, the friction torque generation means is equipped with an attaching member attached to the opening/closing member shield and a rotation member rotatably attached to a free end side of the attaching member and engaged with the opened/closed member, and the friction torque generation means is so designed that it generates a friction torque between the attaching member and the rotation member, so that the opening/closing member shield stops at any opening/closing angle with regard to the opened/closed member. Therefore, in the opening/closing devices it is possible that even though a friction torque as generated between the attaching member and the rotation member is small, a rotation torque in rotating the opening/closing member with regard to the opened/closed member around the guide member as an axis is great, the opening/closing devices of small size and simple structure can realize a stop of the opening/closing member with regard to the opened/closed member using a free stop function.

EMBODIMENTS

In the following the present invention will be described with a particular reference to opening/closing devices for opening/closing a shield with regard to a helmet body and a helmet using the opening/closing devices. However, the opening/closing devices are not limited to those for a shield for helmet, but also, as reference is made to this in the following, can serve as the opening/closing devices for a portable equipment in particular, and broadly speaking for opening and closing opening/closing members with regard to opened/closed members, so that the opening/closing members can stop at any opening/closing angle.

Embodiment 1

Figure 1:
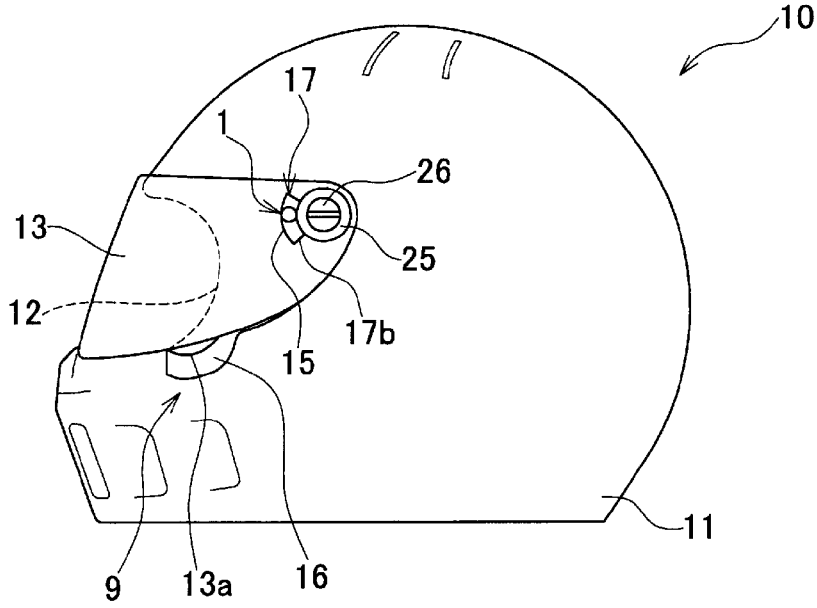
FIG. 1 are views showing an example of a helmet equipped with a shield for helmet according to the present invention, FIG. 1A being a right side view, and FIG. 1B a left side view.
Figure 1:
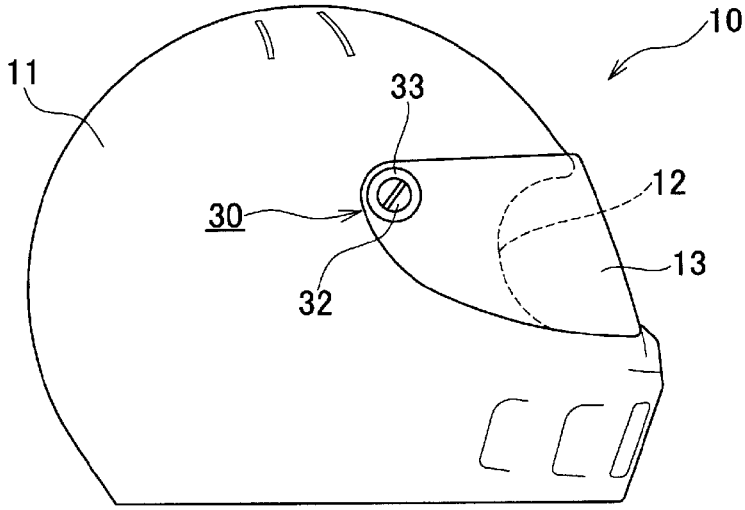
Figure 2:
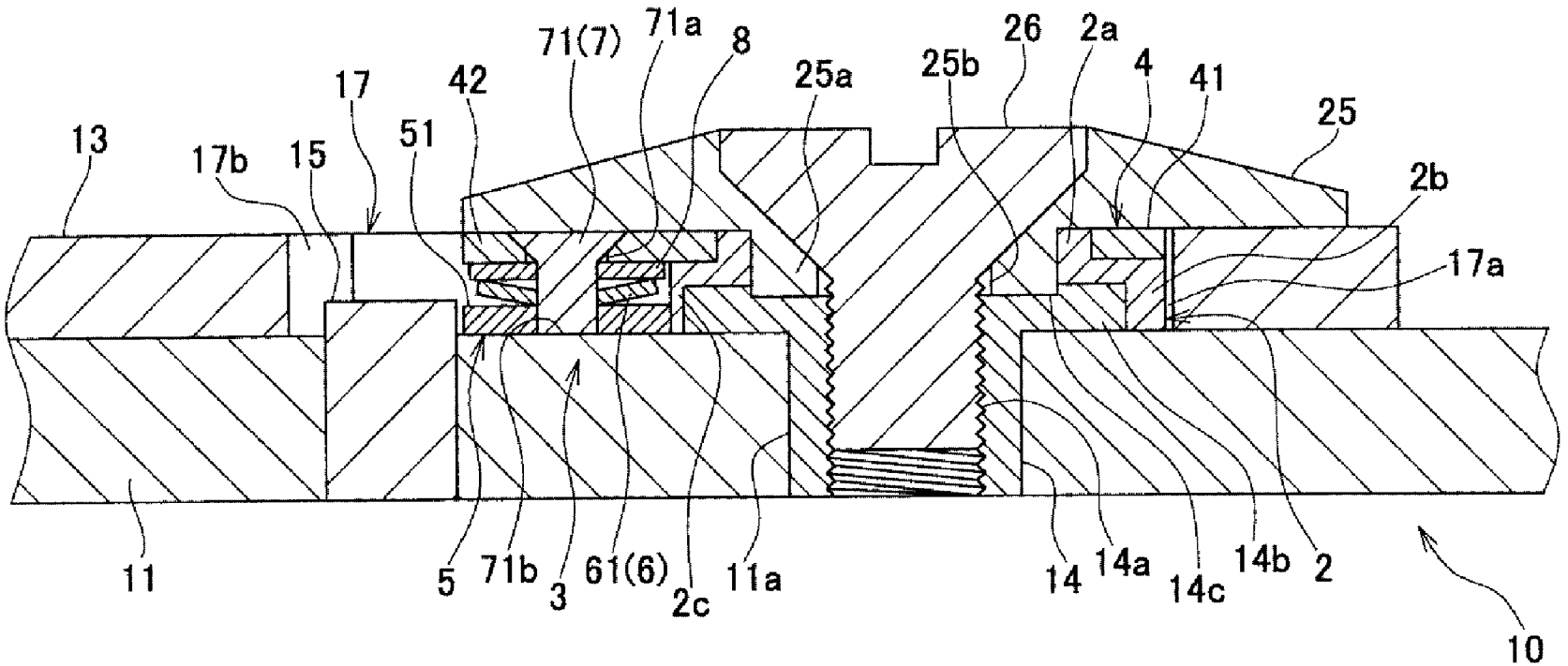
FIG. 2 is a sectional view showing an example of an opening/closing device of a shield for helmet according to the present invention.
Figure 3:
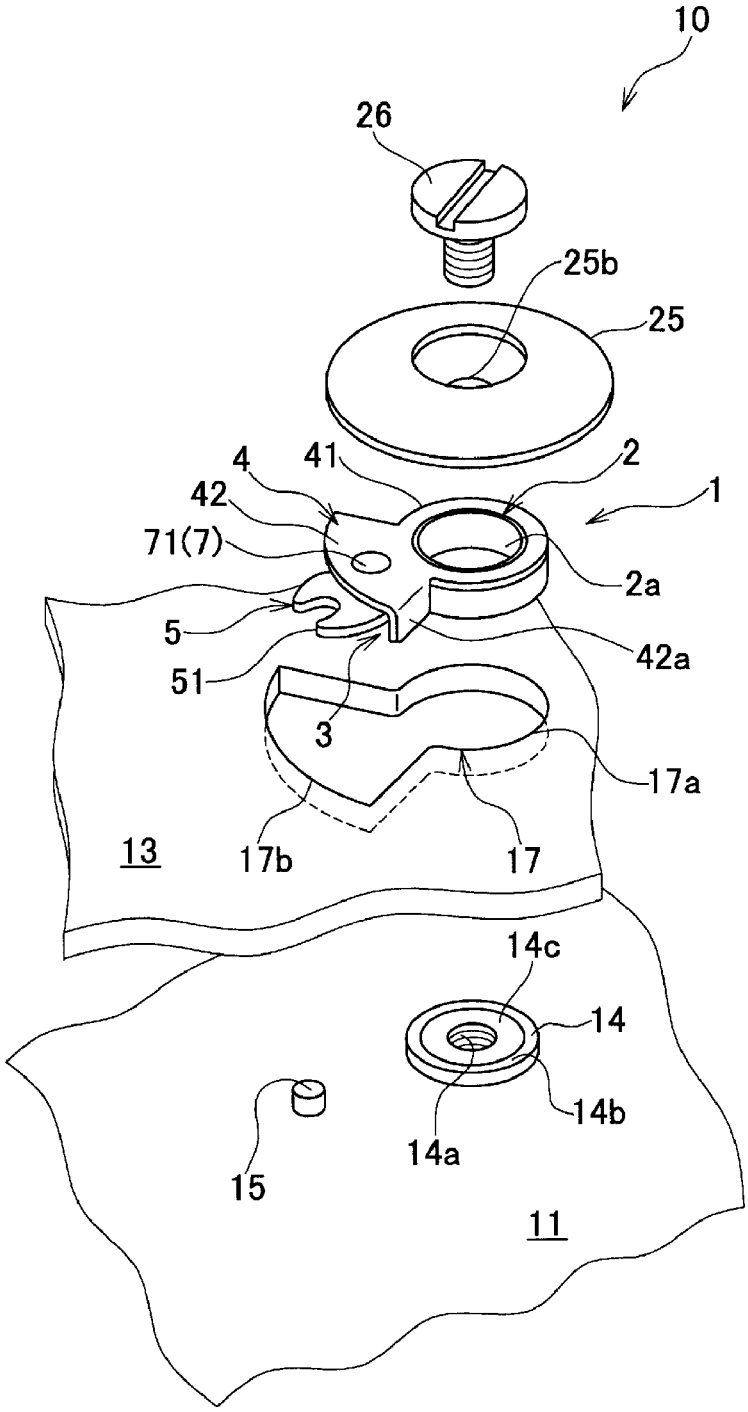
FIG. 3 is an exploded perspective view showing an example of an opening/closing device of a shield for helmet according to the present invention.
Figure 4:
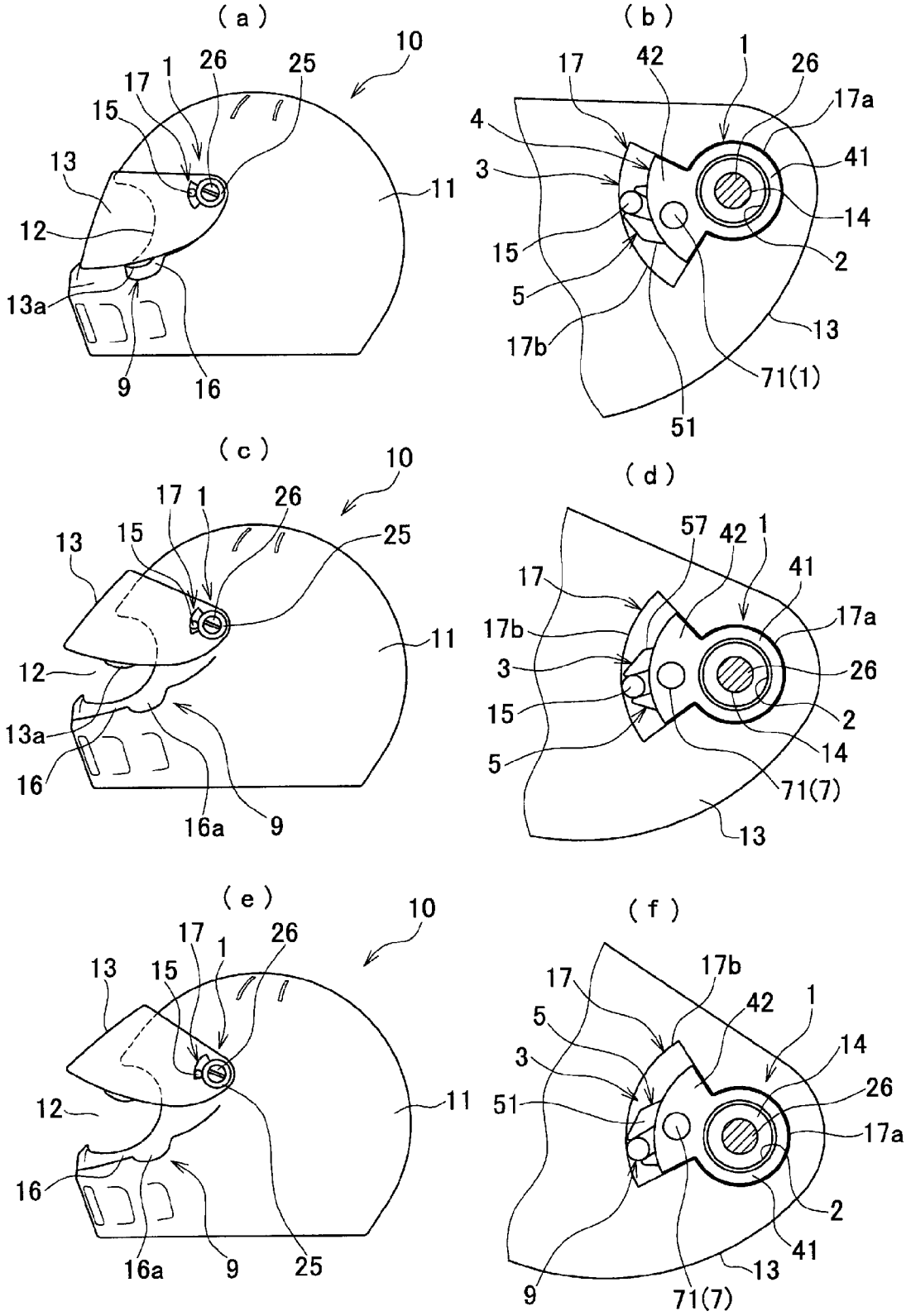
FIG. 4 are views showing an example of a shield for helmet according to the present invention and a helmet equipped with the shield for helmet, FIG. 4A being a side view showing a helmet in a closed state, FIG. 4B a view showing a state of an opening/closing device of a shield for helmet in a closed state, FIG. 4C a side view showing a helmet in an intermediate state, FIG. 4D a view showing a state of an opening/closing device of a shield for helmet in an intermediate state, FIG. 4E a side view showing a helmet in an opened state, and FIG. 4F a view showing a state of an opening/closing device of a shield for helmet in an opened state.
Figure 5:
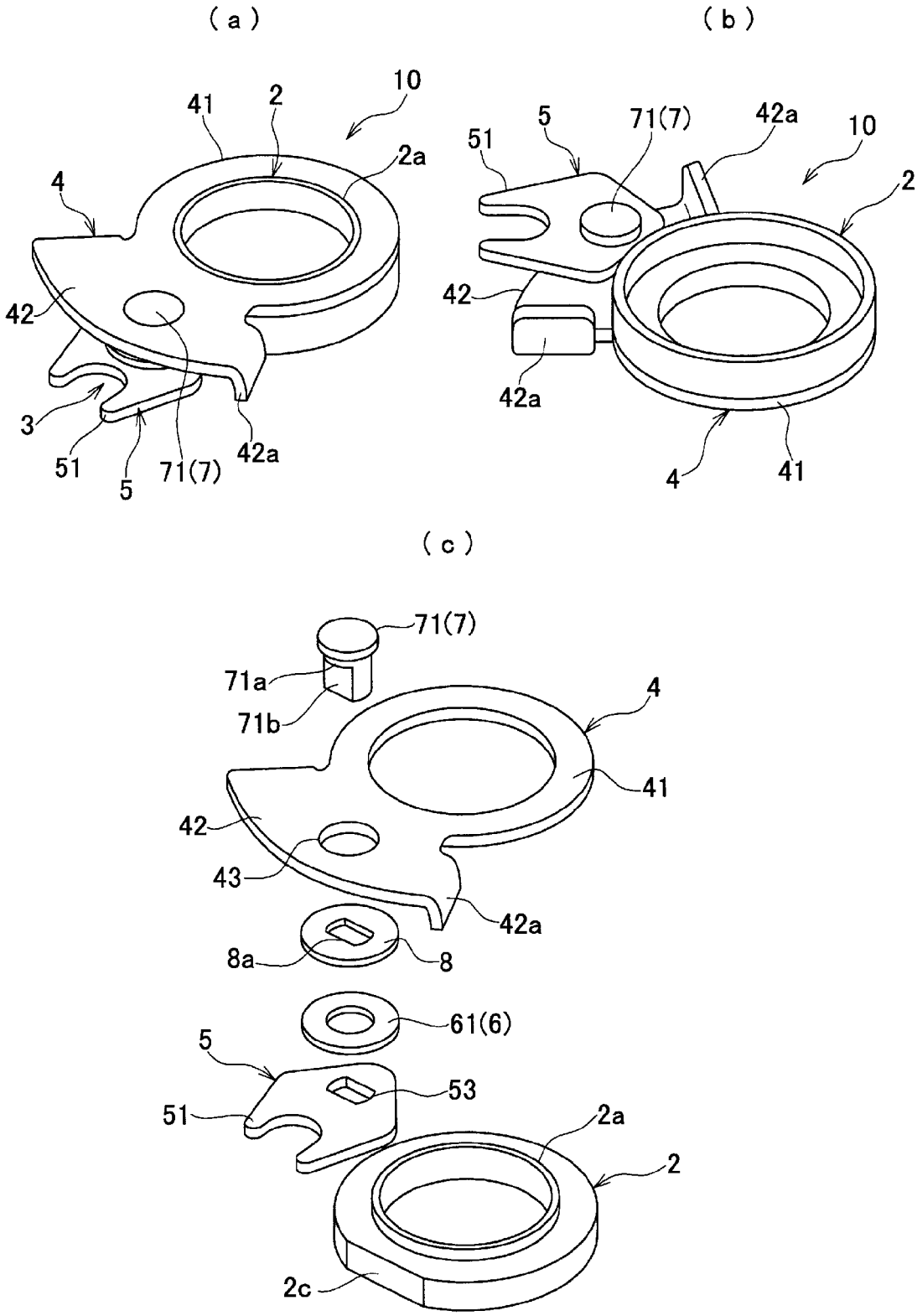
FIG. 5 are views showing an example of main parts of an opening/closing device for a shield for helmet according to the present invention and a helmet equipped with the shield for helmet, FIG. 5A being a perspective view from a front side, FIG. 5B a perspective view from a back side, and FIG. 5B an exploded perspective view.

FIGS. 1 to 4 are views showing an opening/closing device and a helmet equipped with the opening/closing device according to the present invention. FIG. 5 is a view showing main parts of an opening/closing device of a shield for helmet according to the present invention. An opening/closing device openably/closably supports an opening/closing member as a shield 13 of a helmet 10 with regard to a helmet body 11 as an opened/closed member, as shown in FIGS. 1 to 4. The helmet 10 is not particularly limited, as long as the shield 13 is openably/closably attached to it, and examples of the helmet 10 include a full-face helmet for motorcycle and the like. The helmet 10 is equipped with the helmet body 11 having an opening portion 12 opening on a front surface and the shield 13 opening/closing the opening portion 12.

A helmet body 11 is, for example, installed on a head of a rider on a motorcycle and the like, and made up of highly durable synthetic resin material for example. An opening portion 12 is provided on a front surface of the helmet body 11. The opening portion 12 is not particularly limited and, and it is also possible that it is formed, for example, by cutting in a shape substantially of letter U from a lower portion toward an upper portion of the front surface, and in particular, a window opening extending from the front surface toward the both sides is also acceptable, as shown in FIGS. 1 to 4. Attaching bases 14 for rotatably supporting the helmet body 11 are firmly attached on both side portions of the helmet body 11. The respective attaching base 14 is for example formed in a cylindrical shape, and inserted with pressure into respective attaching hole 11*a* of the helmet body 11, so that firmly attached thereto using adhesive. In the meantime, the attaching base 14 herein is firmly attached as separate parts to the helmet body 11, but it is also possible that respective attaching base 14 is integrally provided on the helmet body 11. A groove is provided on an inner circumference of respective attaching base 14, so that the inner circumference as a whole is formed as an attaching hole 14*a*. A flange portion 14*b* is provided on an end portion of the attaching base 14 on the outside of the helmet body 11. A fitting concave portion 14*c* which is substantially coaxial with the attaching hole 11*a* is provided on an outer surface of the flange portion 14*b*. A bearing portion 25*a* of a cover portion 25 made for example of synthetic resin is fittedly installed on the fitting concave portion 14*c*. A through hole 25*b* is provided on a central portion of the cover portion 25, and the cover portion 25 is attached to the attaching hole 14*a* of the attaching base 14 by screwing via the through hole 25*b* into the attaching hole 14*a* of the attaching base 14. Moreover, a means for attaching the attaching base 14 to the helmet body 11 is not limited to the one in the present embodiment, but a nut and the like may be also used and other commonly known means for firmly attaching are also acceptable. Still further, a means for firmly attaching the cover portion 25 to the attaching base 14 may be also provided by threading to a female thread provided on the cover portion 25 a male thread protruding from a side of the attaching base 14. Still further, if the fitting concave portion 14*c* is provided, an attachment of the cover portion 25 to the attaching base 14 is firmly realized, but the fitting concave portion 14*c* can be also cancelled.

A columnar engagement means 15 is provided in vicinity of an attaching base 14 on a left hand side surface of a helmet body 11 and further toward a front side of the helmet body 11. The engagement means 15 can be integrally provided on the helmet body 11, or attached as a separate part such as a pin and the like to the helmet body 11. Furthermore, a shield seating portion 16 in a stepped shape is so configured that a lower portion of a shield 13 seats at the portion when an opening portion 12 is covered with the shield 13. A part of a shield seating portion 16 is recessed in a concave shape downwards and formed as a recessed portion 16*a*. A shield operating piece 13*a* substantially in a half-elliptical shape is provided on a lower end portion of the shield 13 opposing the recessed portion 16*a*, so that an opening/closing of the shield 13 covering the opening portion 12 is facilitated.

A shield 13 is not particularly limited, as long as it can open and close an opening portion 12, and is made up of a transparent and highly durable synthetic resin material. The shield 13 is formed in a curved shape, so that its both end portions cover attaching bases 14 on both side portions of a helmet body 11, when the opening portion 12 is entirely covered. A fitting hole 17 is provided at a position opposing the attaching base 14 and an engagement means 15 on a left side end portion of the shield 13. The fitting hole 17 is formed in a shape which includes a circular portion 17*a* in a circular shape substantially coaxial with the attaching base 14 and a sector portion 17*b* made up of a front side portion of an outer circumference of the circular portion 17*a* protruding in a fan-like shape. An opening/closing device 1 of a shield for helmet is fittedly attached to the fitting hole 17, so that a left side end portion of the shield 13 is rotatably supported via the opening/closing device 1 of a shield for helmet on the helmet body 11. A through hole (not shown in the drawings) is provided at a position opposing the attaching base 14 on a right side end portion of the shield 13. The through hole of the shield 13 is aligned to a position of a hole on the attaching base 14 and an attaching screw 26 is screwed into an attaching hole 14*a* of the attaching base 14, so that a cover portion 25 serves as a bearing member and thus a right side end portion of the shield 13 is rotatably supported on the helmet body 11. In the meantime, washers and the like may be provided both on the outside and the inside of the shield 13, on the outer circumference of the attaching screw 26. With this arrangement, the both end portions of the shield 13 are rotatably supported on the helmet body 11, an opening portion 12 on a front surface of the helmet body 11 can be closed with the shield 13, as well as the opening portion 12 can be opened by rotating the shield 13 with regard to the helmet body 11 from a state of the opening portion 12 closed with the shield 13. In the meantime, one opening/closing device 1 is provided only on the left side end portion, but such an opening/closing device may be provided also on the right side end portion, and still further, similar opening/closing devices may be also provided on both side end portions.

An opening/closing device 1 openably/closably supports a left side end portion of a shield 13 with regard to a helmet body 11, and includes a friction torque generation means 3 provided between the helmet body 11 apart from a guide member 2 and the shield 13. The guide member 2 is formed in a cylindrical shape, which comprises a rotation portion 2*a* as a small diameter portion and a large diameter portion 2*b*, so that an outer surface as a whole has two steps. An inner circumference of the rotation portion 2*a* is formed in a diameter substantially identical to a diameter of an outer circumference of a bearing portion of a cover portion 25. An outer circumference of the rotation portion 2*a* is formed in a circular shape. An inner circumference of the large diameter portion 2*b* is formed in a diameter substantially identical to a diameter of an outer circumference of a flange portion 14*b* of an attaching base 14, with which the guide member 2 is fitted. Further an attaching screw 26 is screwed to the cover portion 25 being fitted to the guide member 2. Still further, a straight portion 2*c* cut in a shape of a straight line is provided on an outer circumference of the large diameter portion 2*b* of the guide member 2 on a side of the friction torque generation means 3. The friction torque generation means 3 is provided on an outer circumference of the straight portion 2*c*.

A friction torque generation means 3 is equipped, especially as shown in FIG. 5, with an attaching member 4 attached to a shield 13, with a rotation member 5 rotatbly attached to the attaching member 4 and engaged with a helmet body 11, and with an elastic member 6 for generating a friction torque between the attaching member 4 and the rotation member 5.

An attaching member 4 is fittedly attached to a fitting hole 17 of a shield 13. The attaching member 4 is so formed that it can be fitted into a fitting hole 17 of a shield 13, and in other words, the member comprises a rotation supporting portion 41 and an attaching portion 42 protruding from an outer circumference of the rotation supporting portion 41 in a fan-like shape. In other words, the attaching member 4 is so formed that it can integrally move together with the shield 13. The rotation supporting portion 41 is formed with an outer diameter in such a size that the rotation supporting portion 41 is fitted into a circular portion 17*a* of the fitting hole 17, as well as with an inner diameter in a size slightly larger than an outer diameter of a rotation portion 2*a*, so that the rotation supporting portion 41 is rotatably attached to an outer circumference of a rotation portion 2*a* of a guide member 2. In the meantime, the rotation supporting portion 41 can be also integrated with the rotation portion 2*a* of the guide member 2, by caulking the rotation portion 2*a* of the guide member 2. After the attaching member 4 is fittedly attached into the fitting hole 17 of the shield 13, the rotation portion 2*a* of the guide member 2 is inserted into the rotation supporting portion 41 of the attaching member 4 of the shield 13, so that the shield 13 is rotatably supported with regard to a helmet body 11.

An attaching portion 42 is fitted into a sector portion 17*b* of a fitting hole 17, as well as so formed that a radial length of the attaching portion 42 is slightly shorter than that between points opposing to engaging means 15. Moreover, both end portions of the attaching portion 42 are bent substantially at right angle toward a helmet body 11, so that the portions are formed as fitting attaching pieces 42*a* being in surface contact or the like condition with both end portions of the sector portion 17*b* of the fitting hole 17. A through hole 43 in a circular shape for example is provided substantially on a central portion in an arc direction of the attaching portion 42. A torque pin 7 is inserted into the through hole 43. The torque pin 7 is, for example, a torque pin 71 with a head portion having a diameter larger than the through hole 43, and the like.

A torque pin 71 is inserted in a direction of a helmet body 11 and thus installed into a through hole 43 of an attaching portion 42. A portion of the torque pin 71 opposing to the through hole 43 is formed as a circular portion 71*a* in a circular shape, while a portion from the circular portion 71*a* to a tip is formed as a non-circular portion 71*b* in a substantially oval shape (a substantially elliptical shape) which is formed by cutting off two opposing portions of a circle which are substantially in parallel. A rotation member 5 is attached to the non-circular portion 71*b* of the torque pin 71.

On a rotation member 5, a non-circular through hole 53 in an oval shape (a substantially elliptical shape) is provided, into which a non-circular portion 71*b* of a torque pin 71 is fittedly inserted. The non-circular portion 71*b* of the torque pin 71 is fittedly inserted into the non-circular through hole 53, and the rotation member 5 is attached, for example by caulking a tip of the torque pin 71 passing through and protruding from the rotation member 5, to the torque pin 71 so as to be rotatable together with the torque pin 71 and movable in an axial direction of the torque pin 71. An engagement concave portion 51 engaged with an engagement means 15 of a helmet body 11 is provided on the rotation member 5, as shown in FIGS. 2 to 5. The engagement concave portion 51 is formed in a shape substantially of a letter U. Due to an engagement of the engagement concave portion 51 with the engagement means 15 in the above-described manner, the rotation member 5 rotates together with the torque pin 71 in a direction different from the direction of rotation of a shield 13, when the shield 13 is rotated around a guide member 2 of the helmet body 11. At this time, an engagement position between the engagement means 15 and the engagement concave portion 51 of the rotation member 5 is displaced from a tip side to a bottom side, which causes a change in a friction torque of a friction torque generation means, so that movements of the shield 13 are felt smoother at the beginning of opening and the end of closing than those at an intermediate opening/closing position.

It is preferable that the shield 13 is provided a rotation range restriction means 9 for restricting a rotation range of the shield 13. The rotation range restriction means 9 is not particularly limited, and it is also possible that it comprises a shield seat portion 16 provided on a helmet body 11, and a rotation member 5 and a fitting attaching piece 42*a* abutting against each other in the opened state. Needless to say, it is also possible that the rotation range restriction means 9 comprises other members and the like. Moreover, the rotation member 5 is configured so as to rotate together with a torque pin 71 in a direction different from a direction of the shield 13, when the shield 13 is rotated around an axis of a guide member 2 of the helmet body 11, but it is also possible that the rotation member 5 is rotatably supported on the torque pin 71 being fixed to an attaching member 4, so that the rotation member 5 rotates together with a torque pin 71 in a direction different from a direction of the shield 13, when the shield 13 is rotated around an axis of a guide member 2 of the helmet body 11. An elastic member 6 is provided for generating a friction torque between the rotation member 5 and the attaching member 4, so that a state of the shield 13 stopping at any position with regard to the helmet body 11 is retained.

An elastic member 6 may be of any configuration, as long as it can generate a friction torque between a rotation member 5 and a attaching portion 42, so that a state of the shield 13 stopping at any position with regard to the helmet body 11 can be retained, and a position for arrangement of the elastic member 6 is not particularly limited. The elastic member 6 is not particularly limited, and may be a leaf spring, a compression spring, and the like, but is preferably a spring washer 61 and the like. The spring washer 61 is provided, for example, around an axis of a torque pin 71 between the rotation member 5 and the attaching portion 42. When the spring washer 61 is thus installed, a friction washer 8 being a torque generation member is provided around an axis of the torque pin 71 between the spring washer 61 and the attaching portion 42. A through hole of the friction washer 8 is formed as a non-circular through hole 8*a* in an oval shape (a substantially elliptical shape), to which a non-circular portion 71*b* of the torque pin 71 is fittedly inserted. In other words, the friction washer 8 is attached to the torque pin 71 so as to rotate together with the torque pin 71 and be movable in an axial direction of the torque pin 71, as well as so configured that the friction washer 8 is pushed via an urging force of the spring washer 61 toward the attaching portion 42. In the meantime, the spring washer 61 is arranged between the rotation member 5 and the attaching portion 42, but arrangement of the washer is not limited thereto, the washer can also be arranged on a side of a tip of the torque pin 71 protruding from the rotation member 5, so that a friction torque is generated between the rotation member 5 and the attaching portion 42 by pushing the rotation member 5 toward the attaching portion 42.

Figure 6:
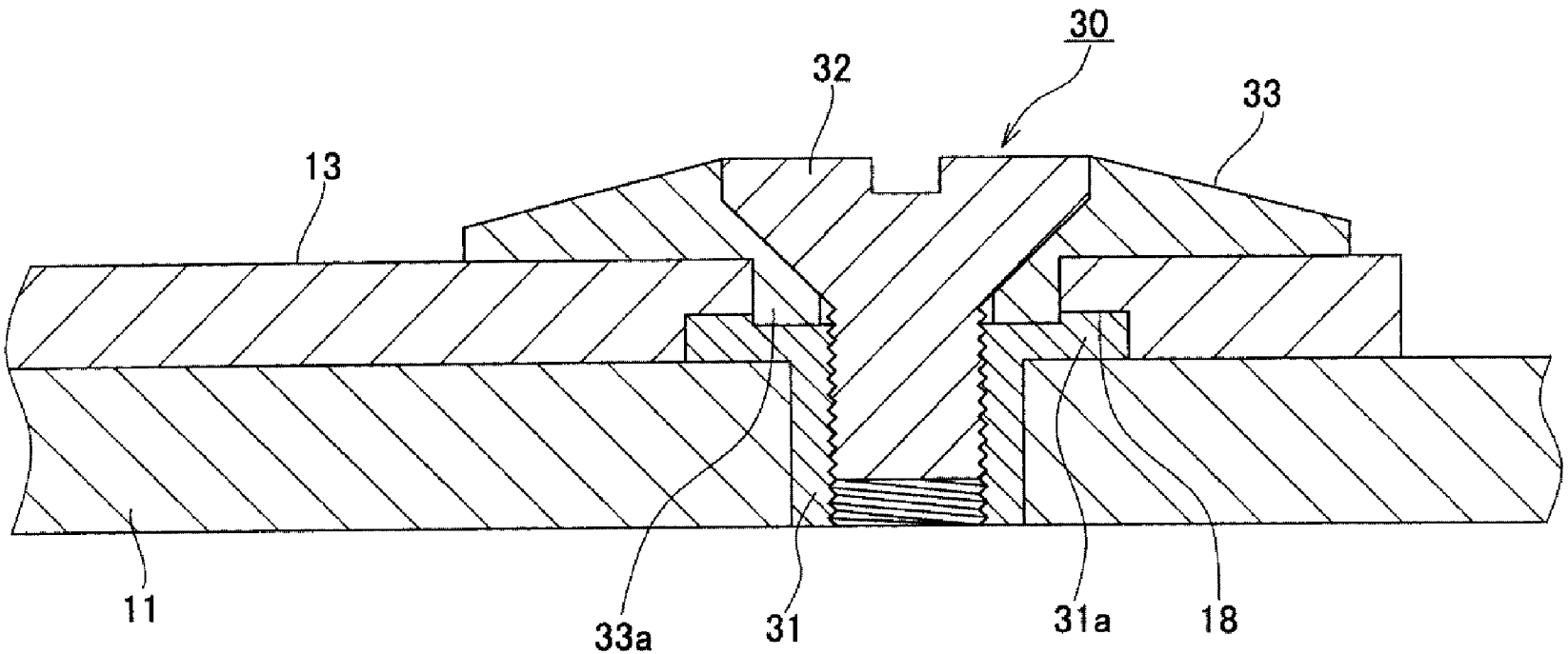
FIG. 6 is a sectional view illustrating an example of an opening/closing device of a shield for helmet as shown in FIG. 1B.

FIG. 6 shows an example of an opening/closing device of a shield for a left side of a helmet, and according to the drawing the opening/closing device 30 of shield comprises an attaching base 31 attached on a side of a left side portion with an axis common with the above-described attaching base 14, and a cover portion 33 attached via an attaching screw 32 to the attaching base 31, and rotatably bears an stepped attaching hole 18 provided on one end portion of a shield 13 by means of an outer circumference of a flange portion 31*a* of the attaching base 31 as well as a bearing portion 33*a* provided on the cover portion 33. In the meantime, the attaching hole 18 does not have to be stepped. Bearings for the attaching hole 18 are not necessarily both of the flange portion 31*a* of the attaching base 31 and the bearing portion 33*a*, but either one of the both. Moreover, configurations of the attaching base 31 and the cover portion 33, still further a way of attaching the both can be all those in the above-described variant.

In the following, a function of the opening/closing device 1 of the shield for helmet and the helmet 10 according to the present invention is described. Description is herein omitted concerning the opening/closing device 30 of the shield 13, since there are not any particular characteristics. The opening/closing device 30 works together with the opening/closing device 1 of the shield for helmet, so that the opening/closing operation of the shield 13 takes place. In the closed state wherein the shield 13 is closed, the lower end portion of the shield 13 seats on the shield seating portion 16 of the helmet body 11, so that the opening portion 12 is closed with the shield 13 (see FIG. 1 and FIG. 4(*a*)). In this state the friction washer 8 is pushed toward the attaching portion 42 of the attaching member 4 by the urging force of the spring washer 61 and the friction torque is thus generated between the attaching member 4 and the rotation member 5, the shield 13 is retained at the closed state, wherein the opening portion 12 is entirely covered. In the meantime, a locking mechanism may also be provided for more securely holding the above-described closed state.

In order to open the opening portion 12 of the helmet 10, the shield 13 is lifted upward against the friction torque generated due to the urging force of the spring washer 61 with securing the helmet body 11, for example, putting user's fingers on the shield operating piece 13*a*, or grasping the piece with the fingers. In this manner, the front surface of the shield 13 moves upward while the shield 13 as a whole is rotated around the guide member 2 being an axis, so that the opening portion 12 is gradually opened from downward. Thereafter, when the movement of the shield 13 is brought to stop where the shield 13 reaches to the intermediate state at a position intermediate between the opened state and the closed state, the shield 13 is held at a state wherein it stops at the state. In other words, when the shield 13 is forced to move upward from the closed state, the left side end portion of the shield 13 is for example rotated toward the right (clockwise)

around the guide member 2 being an axis, and the rotation member 5, accompanied by the rotation, is rotated together with the torque pin 71 toward the left with regard to the attaching portion 42 of the attaching member 4. The rotation of the rotation member 5 is accomplished against the urging force of the spring washer 61, so that once the rotation of the shield 13 is brought to stop, the shield 13 is held at a state wherein it stops at the intermediate state, since the friction washer 8 is pushed by the urging force of the spring washer 61 against the attaching portion 42 of the attaching member 4 and thus the friction torque is generated between the attaching member 4 and the rotation member 5. Therefore, the shield 13 can be brought using free stop function to stop at any position with regard to the helmet body 11.

In the meantime, a configuration of the friction torque generation means as well as type and number of the friction washer and the elastic member are not limited to those in the present embodiment, and the location where the friction torque is generated is not limited to that in the present embodiment. Moreover, it is also possible that a suction function is exercised at opening and closing of the shield with regard to the helmet body using a cam and the like.

When the shield 13 is further lifted upward in order to reach to the opened state where the opening portion 12 is fully opened, the rotation member 5 abuts on the fitting attaching piece 42*a* of the attaching member 4, so that the rotation of the shield 13 is brought to stop. In this state the friction washer 8 is pushed toward the attaching portion 42 of the attaching member 4 by the urging force of the spring washer 61 and the friction torque is thus generated between the attaching member 4 and the rotation member 5, so that the shield 13 is held at the opened state, wherein the opening portion 12 is exposed. In the meantime, a locking mechanism may also be provided for more securely retaining the above-described opened state.

Next, in order to bring back from the opened state, wherein the opening portion 12 is fully opened, to the closed state, the shield 13 is shifted downward against the friction torque generated due to the urging force of the spring washer 61 with securing the helmet body 11, for example, putting user's fingers on the shield operating piece 13*a*, or grasping the piece with the fingers. In this manner, the front surface of the shield 13 moves downward while the shield 13 as a whole is rotated around the guide member 2 being an axis, so that the opening portion 12 is gradually shifted downward. Thereafter, when the opening portion 12 is entirely covered with the shield 13, the lower end portion of the shield 13 seats at the shield seating portion 16, and the rotation of the shield 13 stops and is held at the state of stopping.

As described in the foregoing, the friction torque generation means 3 is provided as a member separate from the shield 13 at a position distanced from the guide member 2 so as to generate a friction torque which brings the shield 13 to stop. Accordingly, even though the friction torque generated between the attaching member 4 and the rotation member 5 both being components of the friction torque generation means 3 is small, a rotation torque generated in rotating the shield 13 with regard to the helmet body 11 around the guide member 2 being an axis is great, so that the friction torque generation means 3, even though of a small size, can securely retain the state of stopping of the shield 13 with regard to the helmet body 11 at any position. In other words, the friction torque generation means 3 can bring the shield 13 to stop at any position using a free stop function. The friction torque generation means 3 is of a small size as above described, so that it is well applicable also to the helmet 10, which can only assure a small space for this purpose.

Embodiment 2

Figure 7:
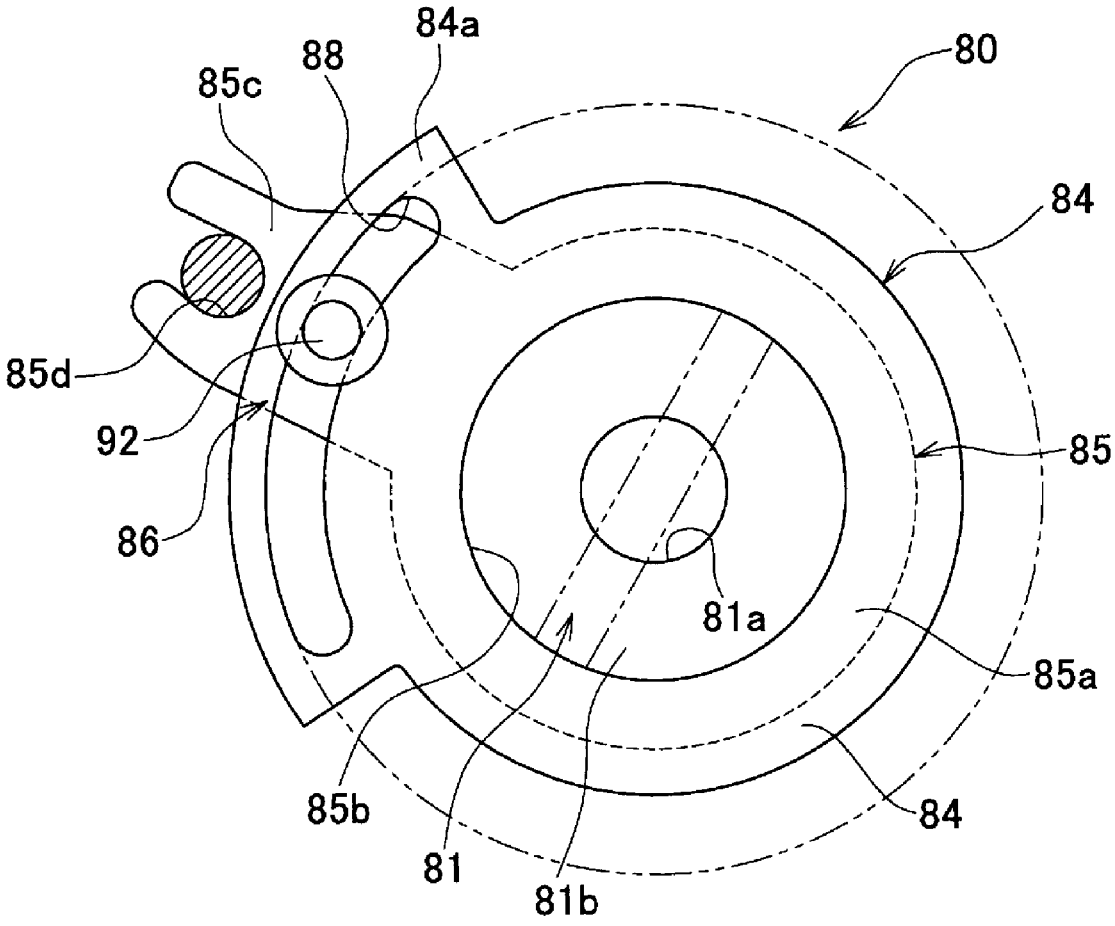
FIG. 7 shows another example of an opening/closing device of a shield for helmet as shown in FIG. 1B according to the present invention, being a plan view omitting a cover portion and an attaching screw.
Figure 8:
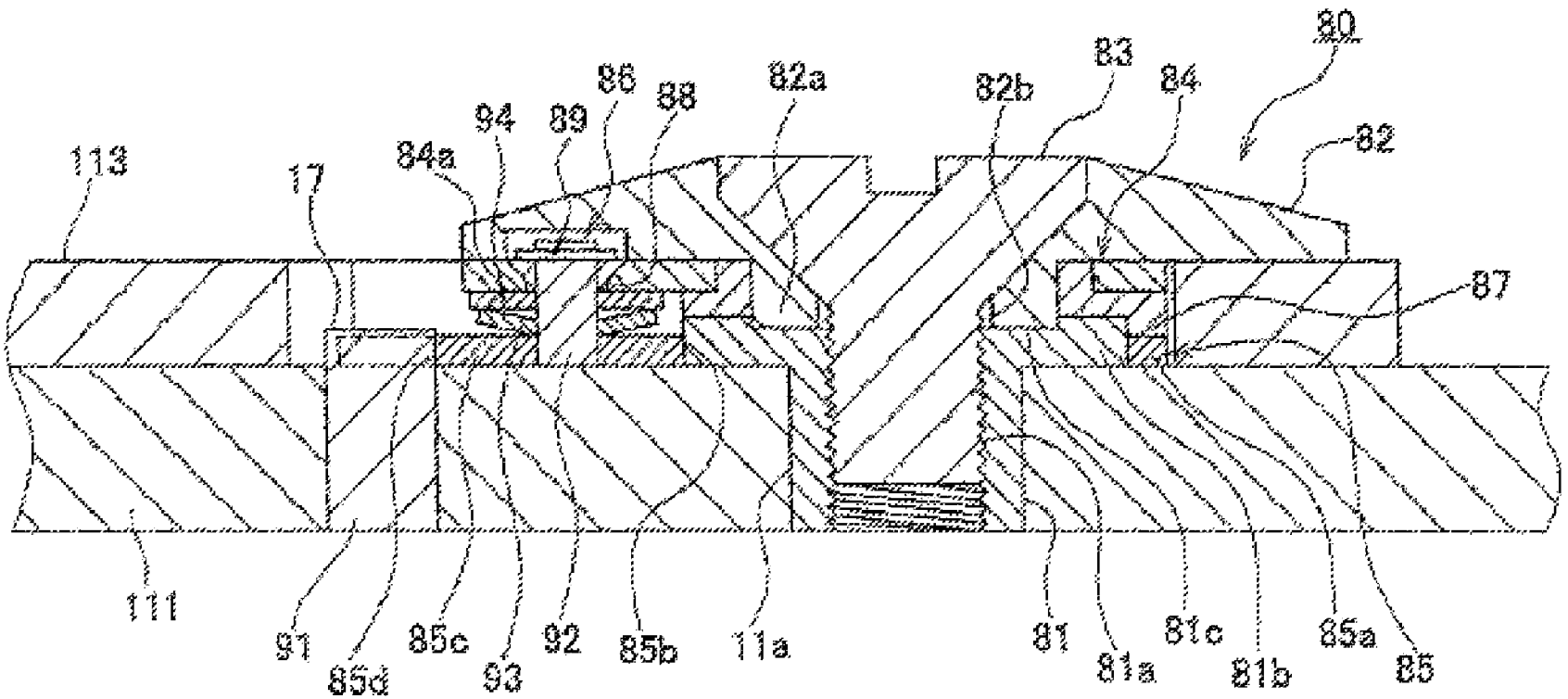
FIG. 8 is a sectional view showing an overall structure of an opening/closing device of a shield for helmet as shown in FIG. 7.

FIGS. 7 and 8 show another example of an opening/closing device of a shield for helmet according to the present invention. FIG. 7 is a drawing as seen in a plan view without a cover portion and an attaching screw, and FIG. 8 an overall sectional view. According to the drawings, to an opening/closing device 80 of a shield for helmet according to embodiment 2, an attaching base 81 for rotatably supporting the helmet body 11 is fixed. The attaching base 81 is formed in a cylindrical shape, and inserted with pressure into an attaching hole 11*a* of the helmet body 11, so that the attaching base 81 is firmly attached thereto for example using adhesive. In the meantime, the attaching base 81 herein is firmly attached as separate parts to the helmet body 11, but it is also acceptable that an attaching base 81 is integrally provided on the helmet body 11. A groove is provided on an inner circumference of respective attaching base 14, so that the inner circumference as a whole is formed as an attaching hole 81*a*. A flange portion 81*b* is provided on an end portion of the attaching base 81 on an outer side of the helmet body 11. A fitting concave portion 81*c* which is substantially coaxial with the attaching hole 11*a* is provided on an outer surface of the flange portion 81*b*. A bearing portion 82*a* of a cover portion 82 made for example of synthetic resin is fittedly installed on the fitting concave portion 81*c*. A through hole 82*b* is provided on a central portion of the cover portion 82, and the cover portion 82 is attached to the attaching hole 81*a* of the attaching base 81 by screwing via the through hole 82*b* into the attaching hole 81*a* of the attaching base 81. Moreover, a means for attaching the attaching base 81 to the helmet body 11 is not limited to the one in the present embodiment, but a nut and the like may be also used and other commonly known means for firmly attaching are also acceptable. Still further, a means for firmly attaching the cover portion 82 to the attaching base 81 may be also provided by threading to a female thread provided on the cover portion 82 a male thread protruding from a side of the attaching base 81, other than the one in the present embodiment. Still further, if the fitting concave portion 81*c* is provided, an attachment of the cover portion 82 to the attaching base 81 is firmly realized, but the fitting concave portion 81*c* can be also cancelled.

Next, a guide long hole 88 in an arc shape is provided on an attaching portion 84*a* of an attaching member 84 which is fittedly inserted into a fitting hole 17 provided on a shield 13, so that the attaching member 84, accompanied by an opening/closing operation, rotates together with a guide member 87, with a bearing portion 82*a* of a cover portion 82 being a rotation center. The guide member 87 is pivotally supported on the bearing portion 82*a* of the cover portion 82 so as to be rotatable. The attaching member 84 and the guide member 87 may be so configured, either that each rotates accompanied by the other, or that each rotates independently of the other. Moreover, a configuration with the guide member 87 facilitates a smooth rotation operation of the attaching member 84, but a configuration without the guide member 87 is also conceivable. A fixing arm 85 comprises an attaching hole 85*b* provided on a base portion 85*a*, and a flange portion 81*b* of an attaching base 81 is inserted into the attaching hole 85*b*. The fixing arm 85 is thus non-rotatably fixed to a helmet body 11 by engaging an engagement concave portion 85*d* provided on a tip of a fixing portion 85*c* protruding from the base portion 85*a* with an engagement member 91 protruding from the helmet body 11.

In the meantime, while in a configuration of the above-described embodiment 1, a friction torque generation means 3 generates a friction torque by rotating a rotation member 5 around an axis of a torque pin 71, in the configuration as shown in FIGS. 7 and 8 a friction torque generation means 86 is so configured that it generates a friction torque between an attaching member 84 and a fixing arm 85. In other words, a torque pin 92 protrudes from a fixing portion 85*c* of the fixing arm 85; the torque pin 92 is inserted into a guide long hole 88 and locked so as not to escape from the guide long hole 88, by attaching a locking washer 89 onto an exposed portion of the torque pin 92. The locking washer 89 may be for example an E-ring or a combination of an E-ring with other locking ring. Further, an elastic member 93 with the torque pin being inserted into the central portion, which comprises a friction washer 94 and for example a spring washer, is arranged between the fixing portion 85*c* of the fixing arm 85 and an attaching portion 84*c* of an attaching member 84. In the meantime, a number, configuration and type of the elastic member and the friction washer are not particularly limited, and may be replaced with the various ones of commonly known configuration.

Also in case that the opening/closing device 80 is configured as above described, an operation and effect substantially identical to those in the previous embodiment 1 are achieved although the friction torque generated is constant, since the friction torque generation means 86 is provided at a position distanced from the attaching member 84 being the rotation center of the shield 13. In other words, even though the friction torque generated between the attaching member 84 and the fixing arm is small, the torque can be adjusted to the rotation torque generated in opening/closing the shield 13 with regard to the helmet body 11, so that the opening/closing device 80, even if of small size, can securely retain the state of stopping of the shield 13 with regard to the helmet body 11 at any position.

Furthermore, in case of the foregoing embodiments, a click stop means can be provided for bringing a shield 13 into a click stop during opening/closing operation. The click stop means is not particularly limited, and, for example, in case of an opening/closing device according to embodiment 1, the click stop means can be configured by restricting a rotation of the friction washer by the torque pin and providing a concave portion and a convex portion on a position of press contact with the rotation member, in such a manner that the both portions oppose each other. In case of an opening/closing device according to embodiment 2, the click stop means can be configured by providing a concave portion and a convex portion on a surface of press contact between the guide long hole 88 and the friction washer 94, in such a manner that the both portions oppose each other. When configured in this manner, the click stop means realizes a release from fitting between the concave portion and the convex portion according to an opening/closing angle of the shield 13 with regard to the helmet body 11, so that a click stop accompanied by a click feeling takes place.

Embodiment 3

Figure 9:
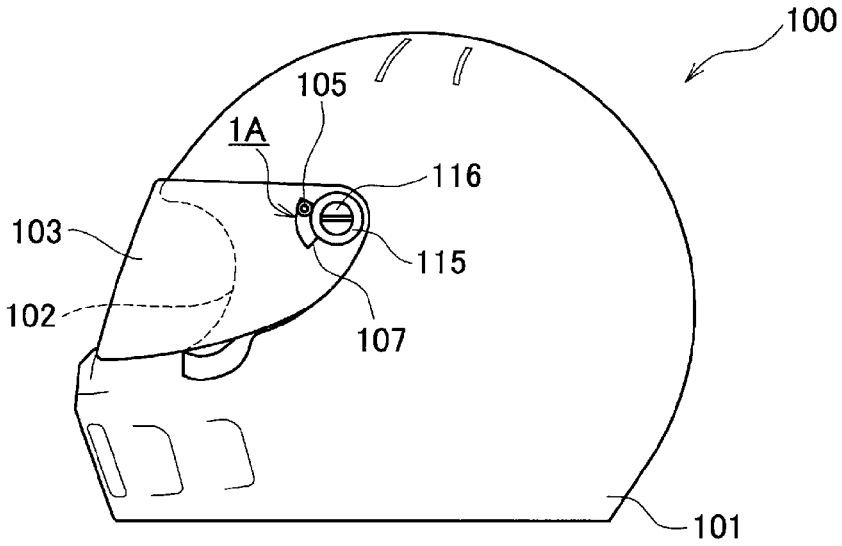
FIG. 9 are side views showing still other example of an opening/closing device of a shield for helmet according to the present invention, FIG. 9A being a right side view, and FIG. 9B a left side view.
Figure 9:
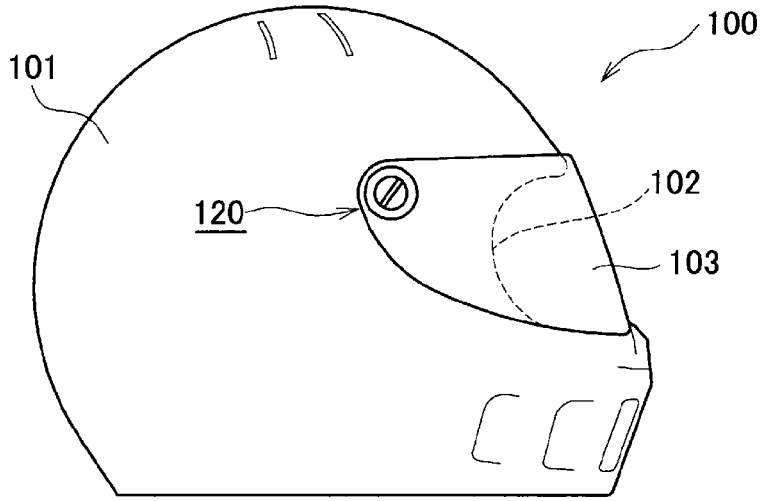
Figure 10:
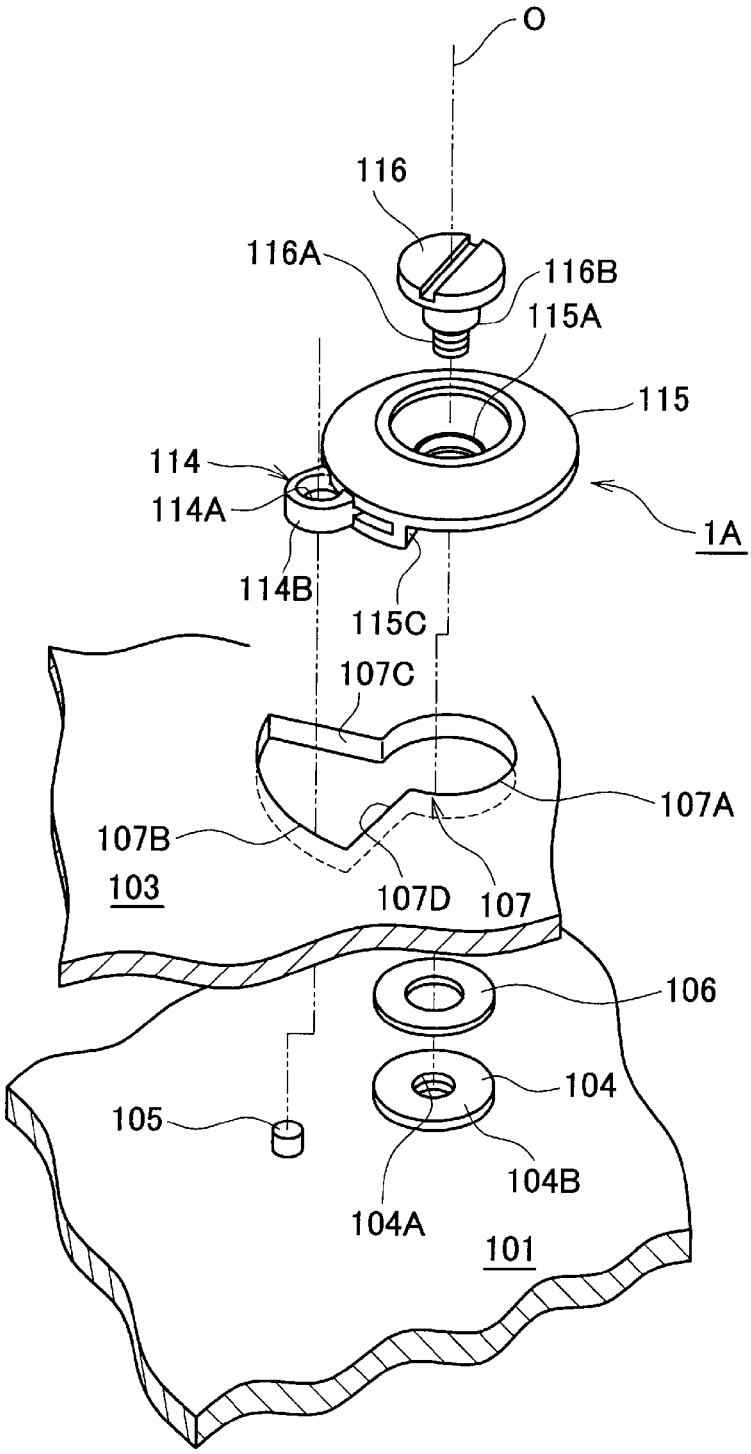
FIG. 10 is an exploded perspective view showing an opening/closing device of a shield for helmet as shown in FIG. 9.
Figure 11:
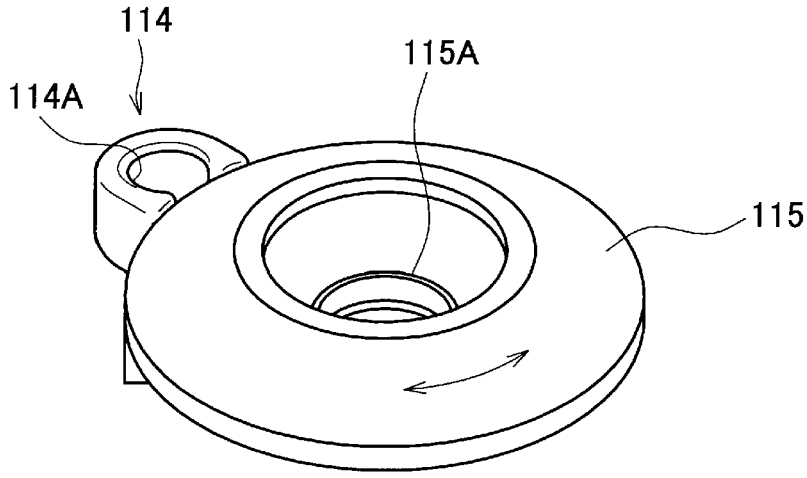
FIG. 11 are views showing an example of an opening/closing device of a shield for helmet as shown in FIG. 9, FIG. 11A being a perspective view as seen from a front side, and FIG. 11B an elevation view.
Figure 11:
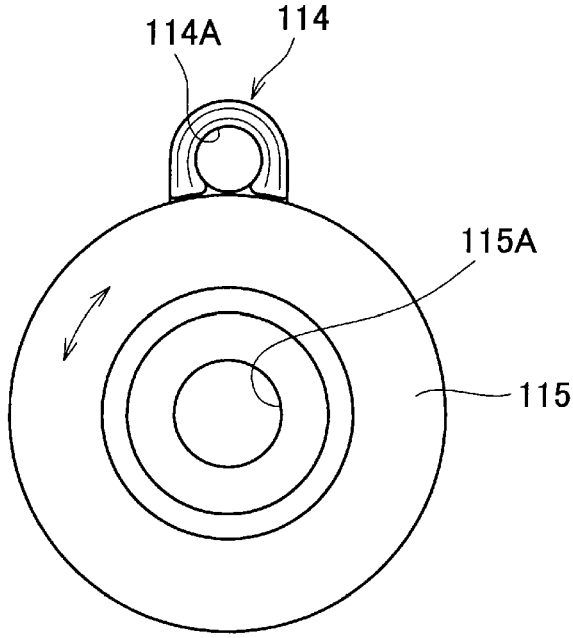
Figure 12:
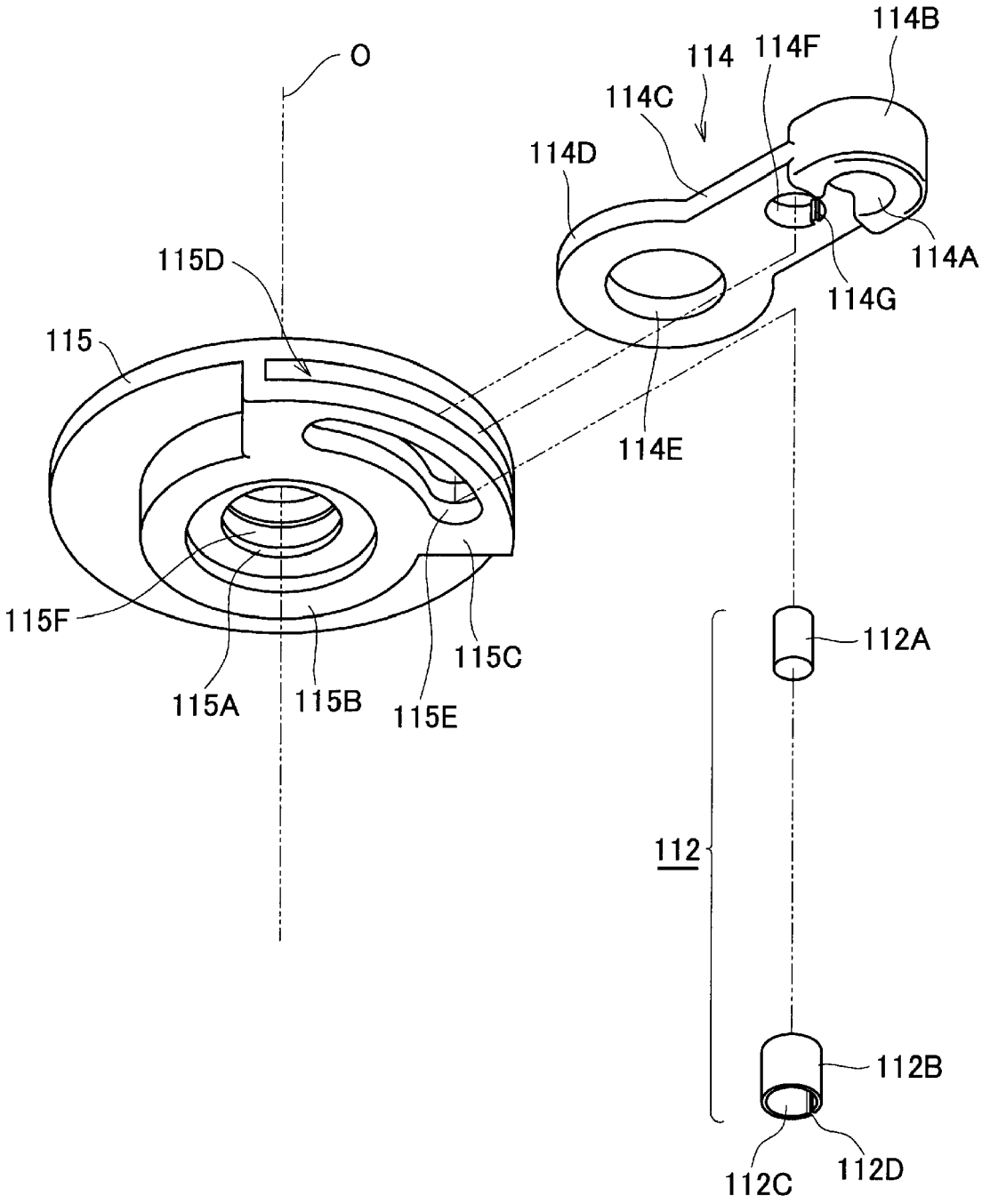
FIG. 12 are views showing an example of an opening/closing device of a shield for helmet as shown in FIG. 9, being an exploded perspective view as seen from a back side.
Figure 13:
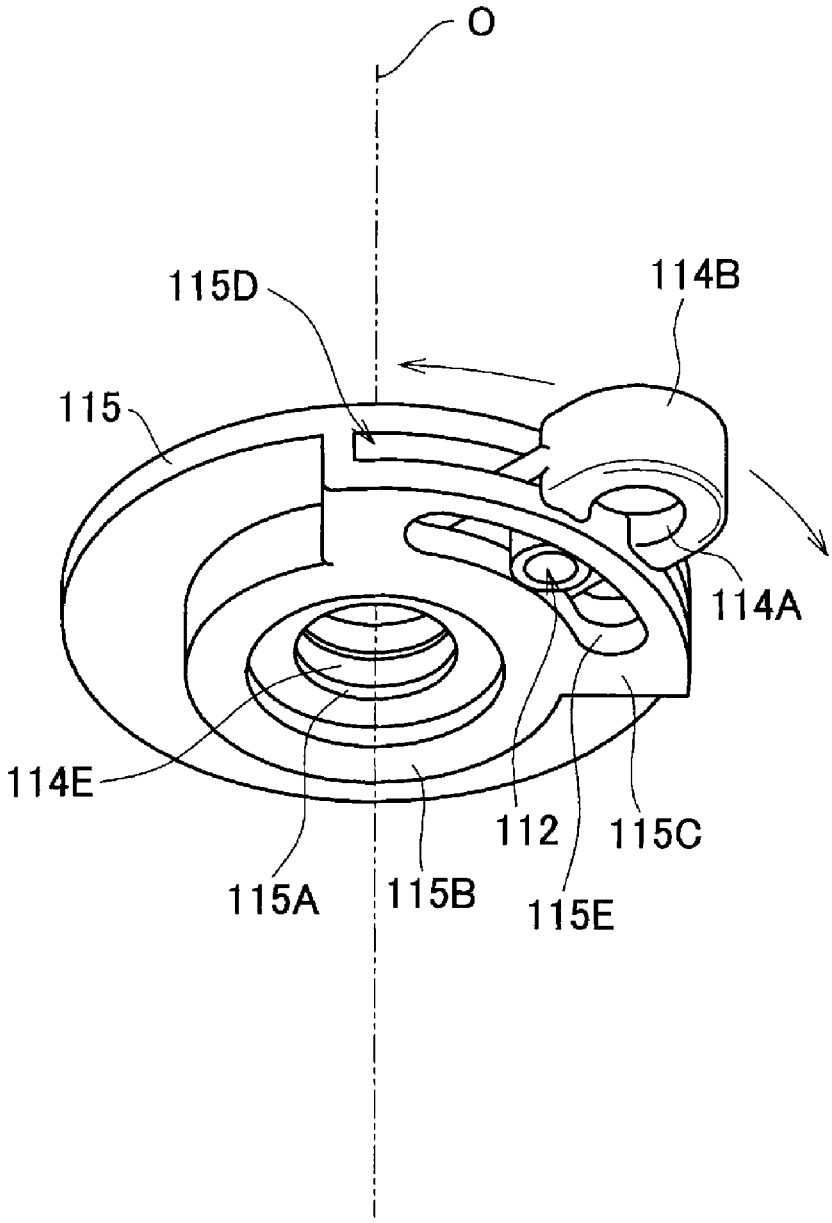
FIG. 13 are views showing an example of an opening/closing device of a shield for helmet as shown in FIG. 9, being a perspective view as seen from a back side.
Figure 14:
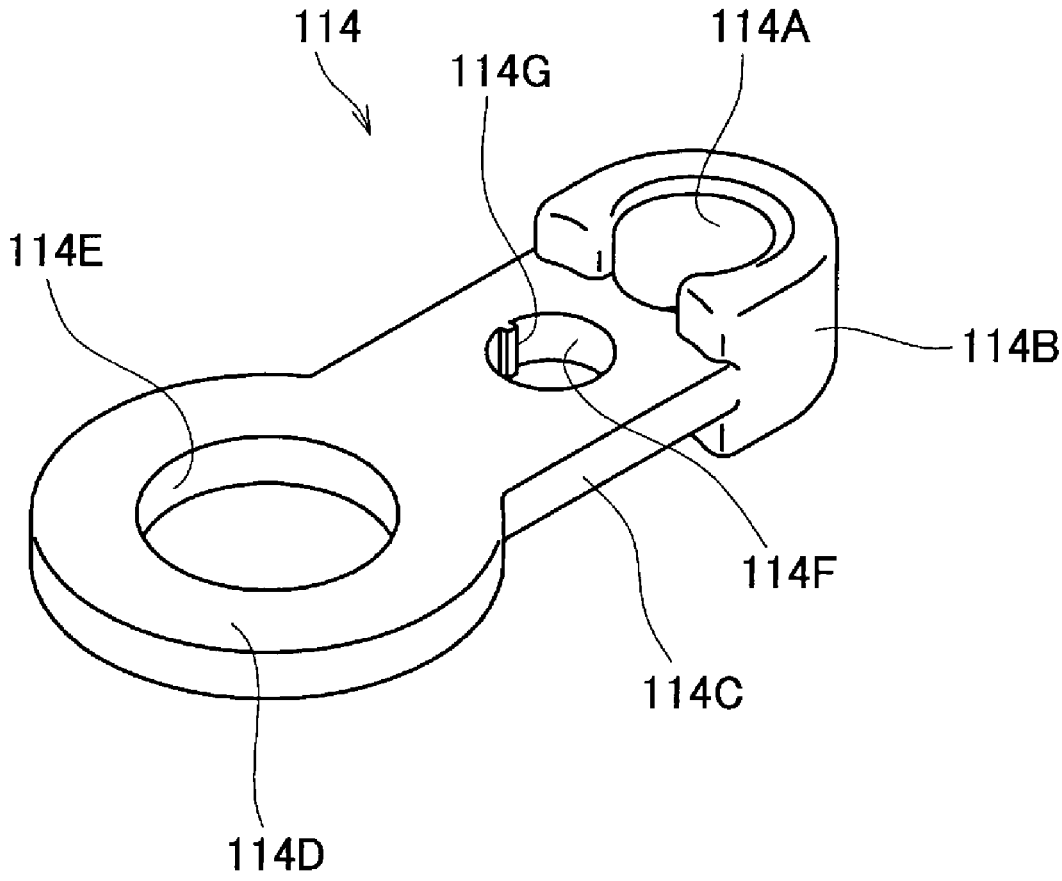
FIG. 14 is a perspective view of an arm member of an opening/closing device as shown in FIG. 9.
Figure 15:
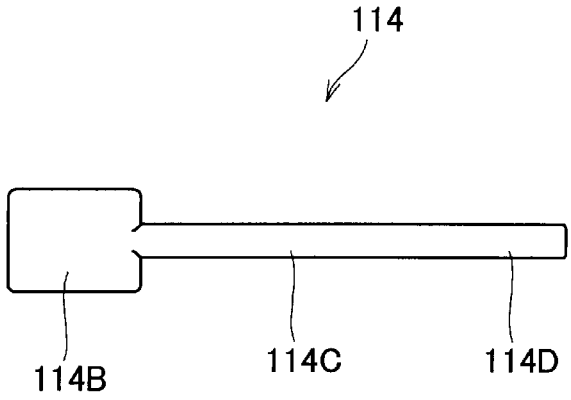
FIG. 15 show an arm member of an opening/closing device as shown in FIG. 9, FIG. 15A being a top view, and FIG. 15B an elevation view, and FIG. 15C a side view.
Figure 15:
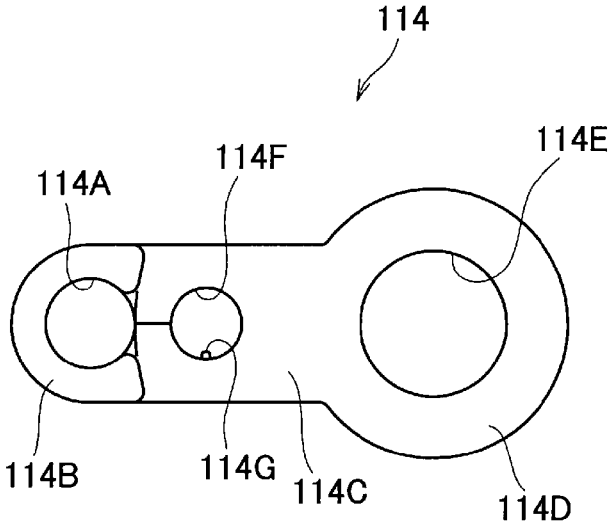
Figure 15:
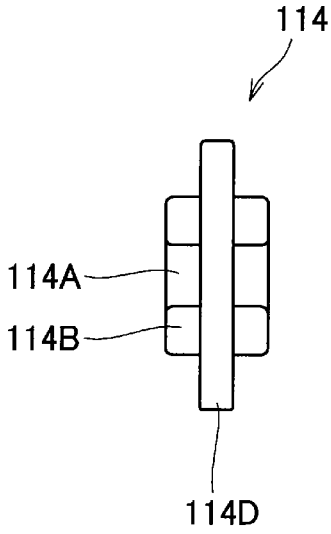
Figure 16:
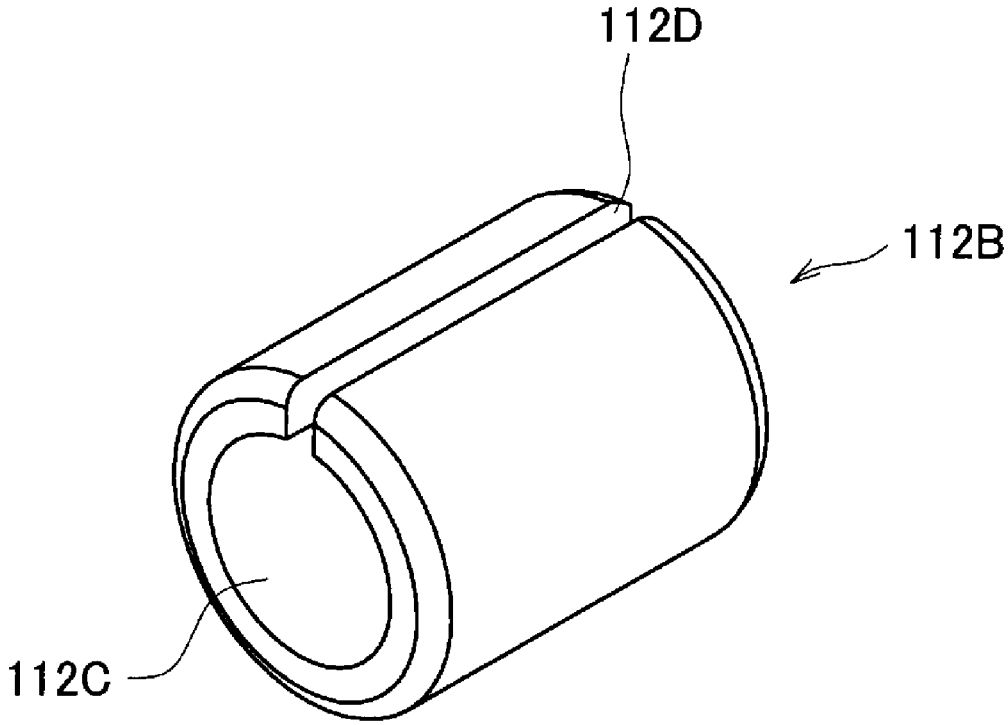
FIG. 16 is a perspective view of a cylindrical portion of an opening/closing device as shown in FIG. 9.
Figure 17:
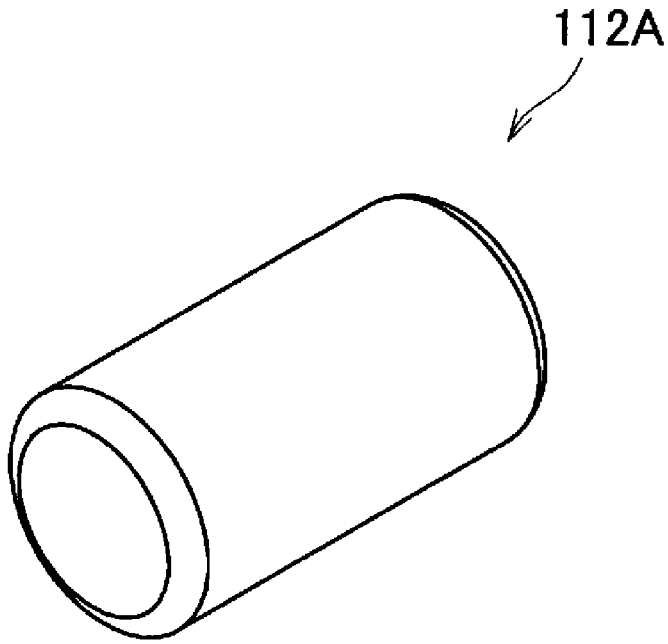
FIG. 17 is a perspective view of an attaching pin of an opening/closing device as shown in FIG. 9.
Figure 18:
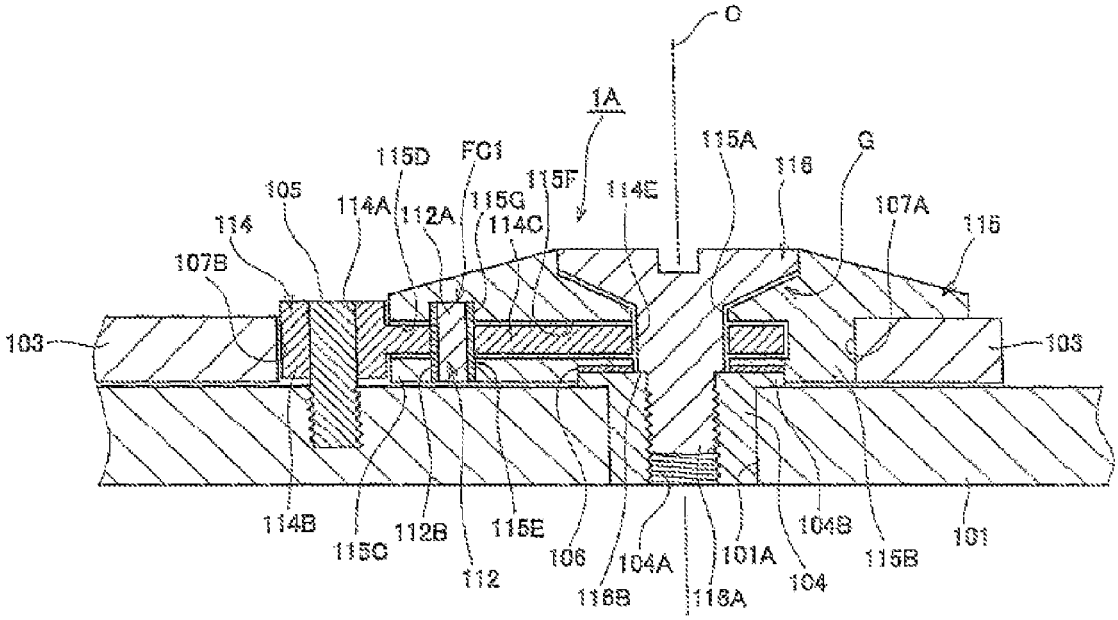
FIG. 18 is a sectional view of an opening/closing device as shown in FIG. 9.

FIGS. 9 to 19 show still other example of an opening/closing device of a shield for helmet according to the present invention. FIG. 9 are side views showing an example of an opening/closing device according to the present invention as applied to a shield for helmet, FIG. 9A being a right side view and FIG. 9B a left side view. FIG. 10 is an exploded perspective view showing an example of an opening/closing device according to the present invention. FIG. 11 are views showing an example of an opening/closing device according to the present invention, FIG. 11A being a perspective view seen from a front side and FIG. 11B an elevation view. FIG. 12 is a view showing an example of an opening/closing device according to the present invention, being an exploded perspective view seen from a back side. FIG. 13 is a view showing an example of an opening/closing device according to the present invention, being a perspective view seen from a back side. FIG. 14 is a perspective view of an arm member. FIG. 15A is a top view, FIG. 15B an elevation view, and FIG. 15C a perspective view of an arm member. FIG. 16 is a perspective view of a cylindrical member. FIG. 17 is a perspective view of an attaching pin. FIG. 18 is a sectional view of an opening/closing device.

<Configuration of Helmet>

A helmet 100 according to the present invention comprises a shield (opening/closing member) 103 openably/closably attached via an opening/closing device 1A to a helmet body (opened/closed member) 101. The helmet 100 is not particularly limited, as long as the shield 103 is openably/closably attached, and includes a so-called "full-face type", wherein a mouth portion and a jaw portion are covered, a so-called "jet type", wherein a mouth portion and a jaw portion are exposed, and the like. In the following description is made based on "full-face type" among these types, but what is described is also applicable to the "jet type" helmet and the like.

A shield 103 is rotatably supported by an opening/closing device 1A on a right side surface (a left side surface as seen from a wearer of a helmet). On the other hand, the shield 103 is also rotatably supported by an opening/closing device 1A different in configuration from the opening/closing device 1 on a left side surface (a right side surface as seen from a wearer of a helmet). This embodiment 2 provided the opening/closing device 30 showing in the embodiment 1.

An opening portion 102 is formed on a front surface of a helmet body 101 for assuring a vision of a wearer, and a shield 103 is so installed that it covers the opening portion 102 so as to be openable/closable via an opening/closing device 1A. When the shield 103 is shifted downward, the opening portion 102 is covered, and when the shield 103 is lifted upward, the opening portion 102 is exposed. The helmet body 101 is, for example, made up of a laminate of a plurality of highly durable synthetic resin materials, shock absorbing materials and the like. Moreover, the shield 103 is, for example, made up of polycarbonate materials and the like, of high strength and durability. Further as is necessary, it is preferable that the shield 103 is subjected to treatment for blocking ultraviolet (UV protection) and preventing scratch, still further for giving polarization properties and the like.

As shown in FIG. 10, an attaching base 104 for attaching and supporting a shield 103 is firmly attached on a side surface of a helmet body 101. The attaching base 104 with a flange portion 104B is formed in a cylindrical shape, and has an inner circumferential surface on which a female thread portion 104A is formed. The attaching base 104 is pressed into an attaching hole 101A so that it is firmly attached via an adhesive which is not shown to the hole, but the attaching base 104, with a male thread portion being provided on an outer side of the attaching base 104, can also be secured by screw into a female thread portion provided on an attaching hole 101A of the helmet body 101 (see FIG. 18). In the meantime, the attaching base 104 is configured as an element separate from the helmet body 101, but can be also arranged so as to be integrally configured with the helmet body 101 according to the case.

<Configuration of Opening/Closing Device>

An opening/closing device 1A comprises a rotation member 115 in a plate shape having substantially a shape of a keyhole, an attaching member 116 for rotatably attaching the rotation member 115 to a helmet body 101 and a friction torque generation means FC1 provided at a position distanced from a rotation fulcrum of the rotation member 115, in particular as shown in FIG. 18. The rotation member 115 is preferably molded using PBT resin (polybutyleneterephtalate), but a method of production is not limited thereto. A through hole 115A in a shape of a watering can rose in a sectional view is formed substantially on the center of the rotation member 115.

A friction torque generation means FC1 comprises, especially as shown in FIG. 18 in the present embodiment 3, a guide groove 115E in an arc shape provided at a position distanced in a radial direction from a rotation center O, an arm member 114 fixed between a fixing pin 105 and an attaching member 116, and a torque pin 112 as an example of a friction means attached to the arm member 114.

On the other hand, a shield 103 is equipped with a fitting hole 107 in a shape of a keyhole integrally made up of a circular fitting hole 107A and a fan-like fitting hole 107B. A shape of the fitting hole 107 exactly corresponds to a plan shape of a rotation member 115 (see FIG. 18), so that the rotation member 115 is fitted into the fitting hole 107 without backlash. In other words, when the rotation member 115 is rotatably attached to a helmet body 101 via an attaching member 116 attached to an attaching base 104 so as to be rotatable with regard to the helmet body 101, the rotation member 115 is fitted with a fitting hole 107 formed on a shield 103 and thus attached via a washer 106 to the fitting hole 107 (see in addition FIG. 18). In the meantime, the washer 106 can be also cancelled. Moreover, in a state where a male thread portion 116A of the attaching member 116 is screwed into a female thread portion 104A on the attaching base 104, especially as shown in FIG. 18, a seating portion 116B of the attaching member 116 abuts on a flange portion 104B on the attaching base 104, so that a further threading is prevented, and at this time a slight gap G is created between the attaching member 116 and the rotation member 115. Accordingly, the slight gap G enables the rotation member 115 to smoothly rotate with regard to the helmet body 101, and thus excludes a possibility of escaping in use of the rotation member 115 or the attaching member 116. In the meantime, an adhesive can be used for preventing from loosening, as is necessary. Moreover, the gap G is shown exaggerated on the drawing for facilitating a comprehension.

As described above, a rotation member 115 is freely rotatable with regard to a helmet body 101, so that a shield 103 as well, which is integrally formed with the rotation member 115 by fitting with a fitting hole 107 of the shield 103, can rotate with regard to the helmet body 101.

Next, a columnar fixing pin 105 is attached at a position closer to an opening portion 102 than an attaching base 104 attached to a helmet body 101. A means for firmly attaching the fixing pin 105 to the helmet body 101 is by pressing into an attaching hole on the helmet body 101, screwing into a female thread portion and the like. When a rotation member 115 is attached via an attaching member 116 to the helmet body 101, the fixing pin 105 is fitted with an attaching hole 114A formed on one end portion of an arm member 114, and a pivotally supporting hole 114E formed on other end portion is pivotally supported on the attaching member 116.

As shown in FIGS. 11 to 13, and 18 and 19, an opening/closing device 1A comprises a rotation member 115, an attaching member 116 attached to a helmet body 101 so as to be rotatable with regard to the helmet body 101 and a friction torque generation means FC1 provided at a position distanced from a rotation fulcrum of the rotation member 115 in a radial direction. The friction torque generation means FC1 comprises an arm member 114 with an attaching hole 114A on one end portion being fitted into a fixing pin 105 and a pivotally supporting hole 114E on other end portion being pivotally supported on the attaching member 116 so as to be coaxial with the rotation member 115, a torque pin 112 attached to a through hole 114F which is so provided that it is located on a side of the attaching hole 114A, and guide grooves 115E and 115G in an arc shape provided on the rotation member 115 and having the torque pin 112 pressed into the grooves. In the meantime, of these guide grooves 115E and 115G (FIG. 18), the guide groove 115G can be cancelled.

As shown in FIG. 12, a rotation member 115 has a shape corresponding to that of a fitting hole 107 substantially in a shape of keyhole in a plan view. In other words, it is integrally made up of a circular erected portion 115B in a circular shape and a fan-like erected portion 115C in a fan-like shape. As a result, an opening/closing device 1A has a more thickness (the thickness from a front side to a back side) in an area with a circular erected portion 115B and a fan-like erected portion 115C being formed than in an area without the above-mentioned portions. Moreover, an arm insertion portion 115F which extends from a portion around an inner circumferential surface toward a side of the rotation member 115 is formed in the area with a more thickness. The arm insertion portion 115F opens over the fan-like erected portion 115C on a side surface of the rotation member 115, and includes an arm insertion opening 115D. Moreover, guide grooves 115E and 115G communicating with the arm insertion opening 115D and the arm insertion portion 115F are formed on the fan-like erected portion 115C. An arc shape formed by guide grooves 115E and 115G has an arc center at a rotation center O of the rotation member 115.

An arm member 114 is an element inserted from an arm insertion opening 115D formed on a side surface of a rotation member 115 over an arm insertion portion 115F into the rotation member 115. The arm member 114 is a plate-like element having a thick portion 114B with one end portion being thicker than the remaining area. An attaching hole 114A which receives an insertion of a fixing pin 105 erected on a helmet body 101 is formed on the thick portion 114B. A circular portion 114D with a pivotally supporting hole 114E is formed on other end portion of the thick portion 114B, and the circular portion 114D is coupled via a coupling portion 114C to the thick portion 114B.

A circular portion 114D is inserted from an arm insertion opening 115D and pivotally supported via a pivotally supporting hole 114E on an attaching member 116.

A through hole 114F of a small diameter is formed on a coupling portion 114C. A key portion 114G serving as a "key" for key coupling is formed on an inner circumferential surface of the through hole 114F along a pass-through direction. A torque pin 112 made up of an attaching pin 112A and fittedly attached around the attaching pin 112A is pressed into the through hole 114F. Moreover, a cylindrical portion 112B is molded for example from a material of excellent friction properties such as POM (polyacetal resin). In the meantime, the cylindrical portion 112B has a hollow structure and a key groove 112D is formed along an axial direction. The key groove 112D is fitted with the key portion 114G formed on the through hole 114F of an arm member 114, and is so fixed that the cylindrical portion 112B would not rotate together with regard to the attaching pin 112A.

Moreover, a diameter of a torque pin 112 is slightly larger than a width of guide grooves 115E and 115G. As a result, the torque pin 112 is in pressure contact with the guide grooves 115E and 115G on their respective both side surfaces. In other words, a friction can be generated in respect to the torque pin 112 on the both side surfaces of the guide grooves 115E and 115G. Due to a presence of the friction generated between the guide grooves 115E and 115G and the torque pin 112, a corresponding torque is necessary in order to rotate a rotation member 115. In the meantime, the torque pin 112 can also be so configured that it is in pressure contact with the guide grooves 115E and 115G on one side surface.

In the meantime, an amount of friction may be adjusted by modifying a material and diameter of a torque pin 112 and a cylindrical portion 112B and further a width and material of guide grooves 115E and 115G as appropriate. Moreover, the torque pin 112 is made up of separate elements which are an attaching pin 112A and a cylindrical portion 112B being elements separate from each other, but the torque pin 112 can be also integrally made up of a single element. Furthermore, it can be integrally made up of a single element together with an arm member 114.

Still further, a range of rotation of a rotation member 115 with regard to an attaching member 116 can also be restricted to a certain range by a shape (width) of an arm insertion opening 115D and guide grooves 115E and 115G, so that such arrangement provides a stopper function as a stopper means to the range of rotation. In other words, in the present embodiment, the range of rotation as restricted above can be as is a range of rotation of a shield 103 with regard to a helmet body 101. Needless to say, the arrangement is not limited to the above, and as described below, a rotation restriction mechanism of some kind can be also separately provided, either between the helmet body 101 and the rotation member 115 or on a side of a shield 103.

<Operation of Helmet and Opening/Closing Device>

Figure 19:
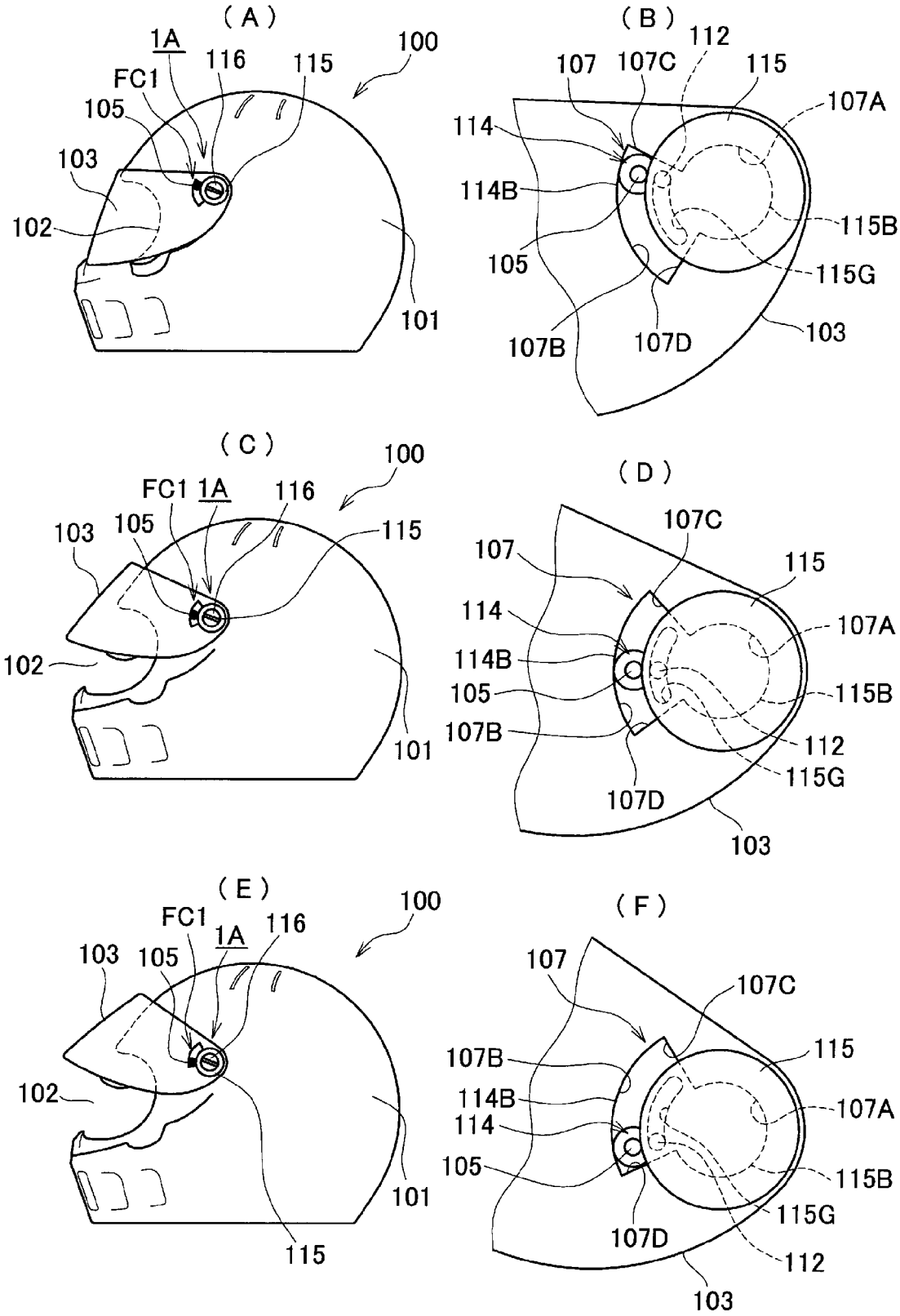
FIG. 19 are views showing a right sectional view of an opening/closing device of a shield for helmet as shown in FIG. 9 and a helmet equipped with the opening/closing device of a shield for helmet, FIGS. 19A and 19B showing a state with a closed shield, FIGS. 19C and 19D showing an intermediate state, and FIGS. 19E and 19F showing a state with an opened shield.

Next, referring to FIG. 19, the operation of the opening/closing device 1A and the helmet 100 is described. Among the drawings of FIG. 19, FIGS. 19A, 19C and 19E show the helmet 100 as a whole, FIGS. 19B, 19D and 19F show the same focused on the area with the opening/closing device 1A. On the other hand, FIGS. 19A and 19B are views showing a closed state, wherein the shield 103 is closed, FIGS. 19C and 19D showing an intermediate opened state, and FIGS. 19E and 19F showing a fully-opened state, wherein the shield 103 is opened. In the meantime, all are illustrated with a part of elements being not shown for facilitating an illustration.

In the state where the shield 103 is closed, the shield 103 entirely covers the opening portion of the helmet body 101. Moreover, the torque pin 112 is located on the uppermost portion (upward in FIG. 19B) of the guide grooves 115E and 115G. At this time, it is also possible that the arm member 114 allows its thick portion 114B to function as a stopper means and determine the closed position of the shield 103 by bringing the thick portion 114B to abut on a side of the upper end portion 107C of the fitting hole 107B in the fan-like shape. Further, the stopper means is constructed by bringing the lower end portion of the shield 103 to abut on the helmet body 101, and still further by bringing either a portion between the arm member 114 and the arm insertion opening 115D or the torque pin 112 to abut on the side of the upper end portion of the guide grooves 115E and 115G.

As shown in FIGS. 19C and 19D, when the shield 103 is in the intermediate opened state (the state between the closed state and the opened state), the thick portion 114B of the arm member 114 is located almost in the middle of the fitting hole 107B. When focused on the torque pin 112 from a different point of view, the torque pin 112 is located almost in the middle of the guide grooves 115E and 115G (almost in the middle in FIG. 19D).

When the shield 103 is in the fully-opened state, the thick portion 114B of the arm member 114 abuts on the lower end portion 107D of the fitting hole 107B in the fan-like shape. When focused on the torque pin 112 from a different point of view, the torque pin 112 is located at the lowermost portion of the guide grooves 115E and 115G.

Since the rotation member 115 as above described is fitted with the side of the shield 103 so that both elements form a single element in the present embodiment, the rotation member 115 rotates, accompanied by the opening/closing operation of the shield 103. On the other hand, the arm member 114 does not rotate. In other words, a relative rotation of the rotation member 115 and the arm member 114 is realized by the opening/closing operation of the shield 103, but when a rotation movement is perceived with a center of the helmet body 101, it appears that only the rotation member 115 rotates, and by no means does the arm member 114.

Moreover, the torque pin 112 is always pressed into the guide grooves 115E and 115G in all of the closed state where the shield 103 is closed, the intermediate opened state and the fully-opened state. Still further, due to the pressed insertion as above described, a friction force is generated between the both of the torque pin 112 and the guide grooves 115E and 115G, when one desires to shift (slide) the torque pin 112 with regard to the guide grooves 115E and 115G. In other words, due to a presence of the friction force, a force for retaining the shield 103 at the position with regard to the helmet body 101 (rotation resistance) is generated. Concretely in the closed state of the shield 103 a force works for retaining the closed state in case that one desires to open the shield 103, and in the intermediate state of the shield 103 a force works for keeping the position in the intermediate state in case that one desires to shift the shield 103, and further in the opened state of the shield 103 a force works for retaining the opened state in case that one desires to close the shield 103. In the meantime, in order to more securely retain the opened state and the closed state of the shield 103, a locking mechanism may be also separately provided.

In order to expose the opening portion 102 of the helmet 100, the shield 103 is lifted upward against the friction torque of the friction torque generation means FC1, for example by putting fingers on the shield 103 or grasping the shield 103 with the fingers, while the helmet 101 is fixed (for example installed on the head). By this action, the shield 103 rotates around the attaching member 116 (in other words, around the rotation center O being a center of the through hole 115A formed on the rotation member 115), so that the opening portion 102 is gradually exposed, then realizing the fully-opened state, wherein the opening portion 102 is exposed. Further, when a shift of the shield 103 is arrested, the shield 103 is retained in a state of stopping at the position. The retaining action functions in any of the intermediate opened states in the same manner. In other words, a state where the shield 103 is retained at any opened position, so-called "free stop state" can be realized.

Furthermore, when the shield 103 is in the fully-opened state with regard to the helmet body 101, the torque pin 112 is located on the lowermost portion of the guide grooves 115E and 115G. At this time, it is also possible that the arm member 114 allows its thick portion 114B to function as a stopper means and determine the fully-opened position of the shield 103 by bringing the thick portion 114B to abut on a side of the lower end portion 107D of the fitting hole 107B in the fan-like shape. However, in an another embodiment, the stopper means may constructed by bringing the upper end portion of the shield 103 to abut on the helmet body 101, and still further by bringing either a portion between the arm member 114 and the arm insertion opening 115D or the torque pin 112 to abut on the side of the lower end portion of the guide grooves 115E and 115G, in the above-described manner.

On the other hand, in order to close the shield 103, it can be closed for example by grasping the shield 103 with the fingers, on the contrary to what is described above. When the closing operation stops, the shield 103 stops at the same time, and the shield 103 is retained at the position in any of the intermediate states (the intermediate positions) during the closing step.

As described above, an opening/closing device 1A according to embodiment 3 being an example of embodiments of the present invention supports a shield 103 so that the shield 103 is openable/closable with regard to a helmet body 101 and is equipped with a rotation member 115 fixed to the side of the shield 103, an arm member 114 rotating with regard to the rotation member 115, accompanied by the opening/closing operation of the shield 103, and a friction torque generation means FC1 for generating a predetermined friction torque, accompanied by the opening/closing operation of the shield 103. The friction torque generation means FC1 has guide grooves 115E and 115G in an arc shape, both formed on the rotation member 115, and a torque pin 112 fitted into the guide grooves 115E and 115G, and adopts a configuration in which the friction torque generation means FC1 slides under press contact with the torque pin 112 on both side surfaces of the guide grooves 115E and 115G, thus generating a friction torque. By adopting such a configuration, a compact friction torque generation means FC1 can generate a large friction torque. In other words, it can assure a large area for generation of friction by bringing the torque pin 112 into press contact at least with both side surfaces of the guide grooves 115E and 115G thus formed, so that the friction torque generation means FC1 can achieve a sufficient rotation resistance, and thus enables to securely retain the shield 103 at any position. In particular, since the guide groove 115E is formed on the rotation member 115 (which is configured as an element separate from the shield 103), a material producing a high friction coefficient with regard to the torque pin 112 can be freely selected, thus enabling a generation of a larger rotation resistance.

In the meantime, it is also possible that an outer circumferential surface of a thick portion 114B of an arm member 114 is so configured that the surface is intentionally caused to abut on an inner side of a fitting hole 107B in a fan-like shape, and in this manner advantage is taken of a friction generated from sliding of the positions for abutting.

In the meantime, the shape of guide grooves 115E and 115G is defined as being literally "arc", but it is also possible that a click stop means made up of convex portions and concave portions formed at an interval of a predetermined angle on the basis of an arc shape is so provided that the shield 103 undergo a click movement.

Moreover, when a configuration is adopted, wherein one opening/closing device 1A equipped with a friction torque generation means FC1 is respectively provided on each of both side surfaces of the helmet body 101, a combination of the two opening/closing devices 1A can generate a still larger rotation resistance, so that a shield 103 can be more securely retained at a desired opening/closing position, and each single opening/closing device 1A can be configured so as to be more compact.

Embodiment 4

Figure 20:
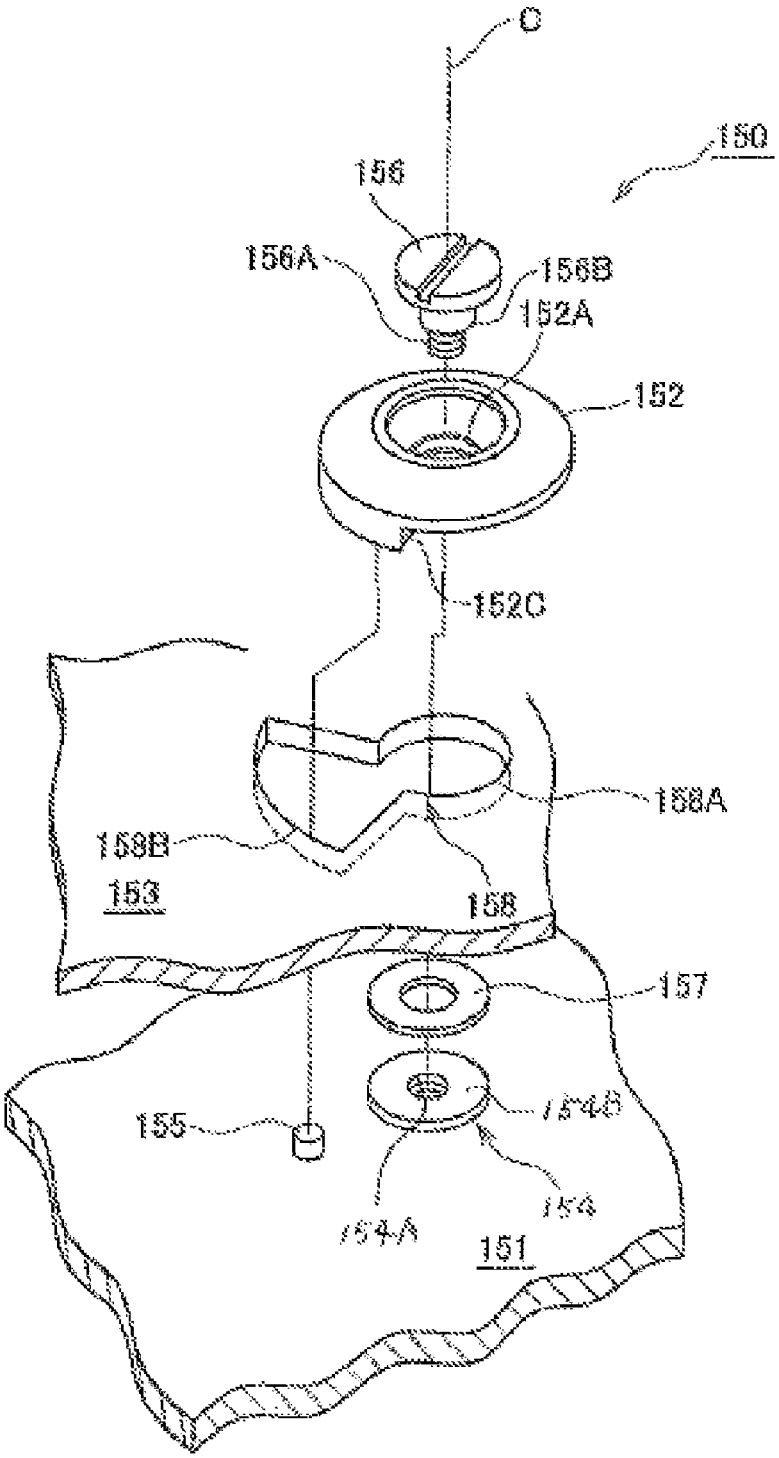
FIG. 20 is an exploded perspective view of an opening/closing device of a shield for helmet according to an embodiment 4 of the present invention.
Figure 21:
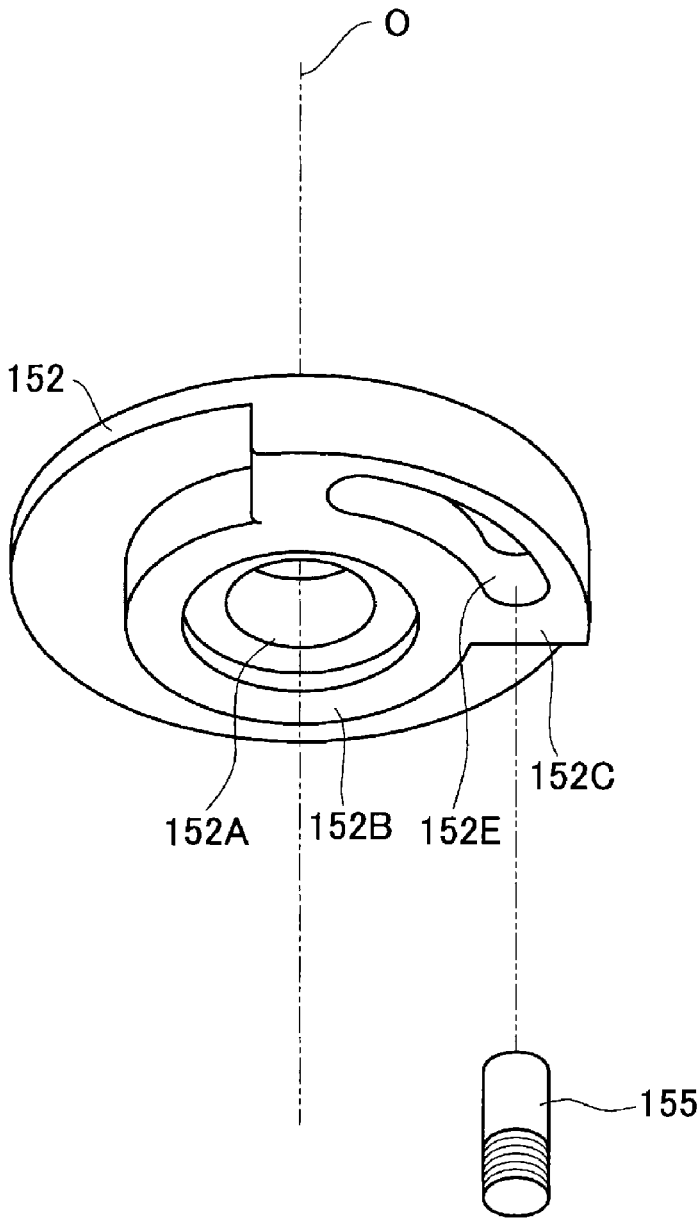
FIG. 21 is a view showing an opening/closing device of a shield for helmet according to an embodiment 4 of the present invention, being an exploded perspective view as seen from a back side.
Figure 22:
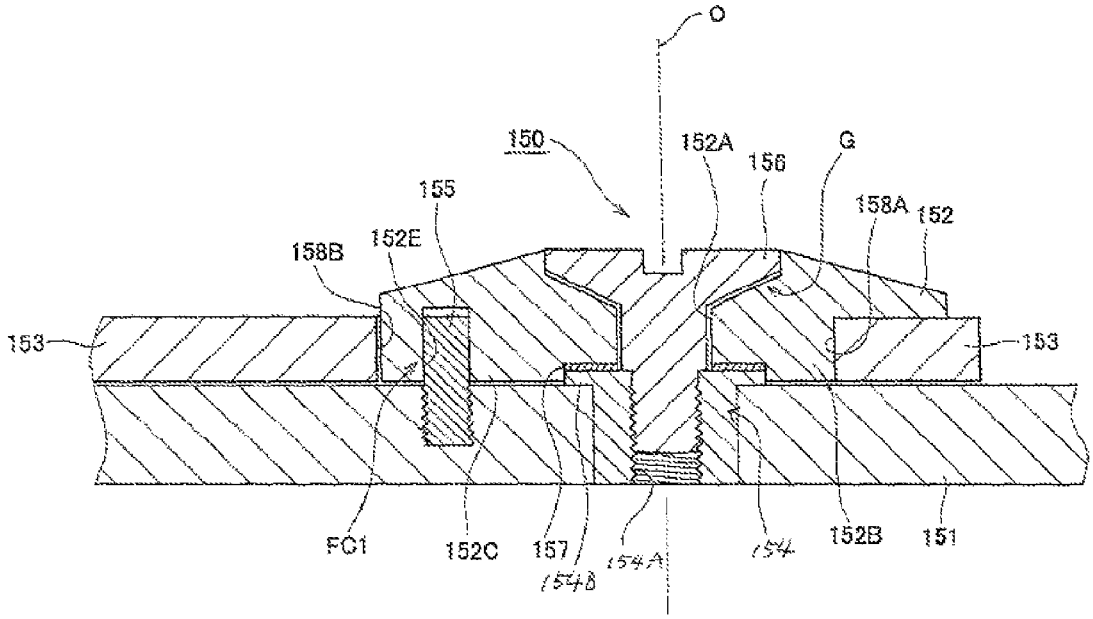
FIG. 22 is a sectional view of an opening/closing device of a shield for helmet according to an embodiment 4 of the present invention.

FIGS. 20 to 22 show still other example of an opening/closing device according to the present invention. Herein FIG. 20 is an exploded perspective view of an opening/closing device according to this embodiment 4. FIG. 21 is a view showing an opening/closing device according to embodiment 4, being an exploded perspective view in a back side view. FIG. 22 is a longitudinal sectional view of an opening/closing device according to embodiment 4.

In the present embodiment 4, a friction torque generation means FC2 adopts a configuration in which a torque pin 155 attached to a helmet body 151 is directly pressed into a guide groove 152E formed on a rotation member 152 being a component of an opening/closing device 150. In other words, a fixing pin 105 and an arm member 114 are cancelled, so that number of component parts can be reduced in seeking for a more compact configuration and a further cost saving. In the meantime, it can be selected at discretion to make up a torque pin 155 of two components in the same manner with a torque pin 112 according to embodiment 3. In addition, element names in relation to other reference numerals shown in FIGS. 20 to 22 are as follows, and reference is made to these elements in random order.

Thus, a reference numeral 152A denotes a through hole, 152B a circular erected portion and 152C a fan-like erected portion; further a reference numeral 153 denotes a shield, 154 an attaching base, 154A a female thread portion and 154B a flange portion. Still further, a reference numeral 151 denotes a helmet body, 157 a washer, 158 a fitting hole, 158A a circular fitting hole and 158A a fan-like fitting hole. Moreover, a reference numeral 156 denotes an attaching member, 156A a male thread portion and 156A a seating portion. Element names identical to those in embodiment 3 have all identical configurations and functions.

As is clear from the foregoing description, an opening/closing device according to the present invention can be also used for purposes other than an opening/closing device of a shield for helmet. It can be used for example as an opening/closing device of a small-sized portable equipment such as a portable phone, a PDA, a notebook PC for opening/closing a first casing provided with an operation portion and serving as opened/closed member and a second casing provided with a display device and serving as opening/closing member.

In this case, a rotation member is attached to a first casing so as to be rotatable via an attaching member, and so configured that it rotates together with a second casing; further a friction torque generation means according to embodiments 2 and 3 is provided between the rotation member and the first casing.

As described in detail in the foregoing, the present invention is described in general in reference to an opening/closing device of a helmet, wherein an opened/closed member is a helmet body of the helmet used in driving automobile and motorcycle and the like, and an opening/closing member is a shield. However, the present invention can be also widely applied to various helmets such as a helmet for bicycle and the one used in a construction site and the like, and further to an opening/closing device of an information terminal such as a portable phone and a PDA.

What is claimed is:

1. An opening/closing device for openably/closably supporting both end portions of shield with regard to a helmet body, said opening/closing device being provided at least on a side of one end portion of said shield and comprising:

a cover portion having a bearing portion and firmly attached to said a helmet body;

an attaching member supported on and attached to said bearing portion of said cover portion so as to rotate together with said shield;

a fixing arm coaxially attached with said attaching member and fixed to said a helmet body;

a torque pin inserted into a guide long hole in an arc shape attached at a position distanced from an attaching center of said fixing arm and provided at a position distanced from a rotation center of said attaching member, and;

a friction torque generation means made up of a friction washer provided between said fixing arm and said attaching member by receiving said torque pin inserted into a central portion of said friction washer, and of an elastic member.

2. An opening/closing device according to claim 1, wherein said attaching member is attached to a bearing portion protruding from a cover portion fixed via an attaching screw to an attaching base attached to said a helmet body, so that said attaching member is rotatably attached to said a helmet body.

3. An opening/closing device according to claim 1, wherein an engagement concave portion is provided on a tip of said rotation member and an engagement means engaged with said engagement concave portion is provided on said a helmet body, in order to engage said rotation member with said a helmet body.

4. An opening/closing device according to claim 1, wherein said friction torque generation means comprises a torque pin for rotatably attaching said rotation member to an attaching portion of said attaching member, a friction washer receiving said torque pin being inserted into a central portion of said friction washer in an axial direction, and thus interposed between said attaching portion and said rotation member, and an elastic member.

5. An opening/closing device for supporting a shield in opening and closing with regard to an a helmet body, so that said a shield can stop at any opening/closing position, said opening/closing device comprising:

a rotation member fixed to a side of said opening/closing member;

an attaching member for attaching said rotation member to said opened/closed member, so that said rotation member is rotatable with regard to said opened/closed member, and;

a friction torque generation means provided between said opening/closing member and said a helmet body; and wherein said friction torque generation means comprises:

guide grooves provided at a position distanced from a rotation center of said rotation member, and;

a friction means fitted into the guide grooves so as to be movable with friction.

6. An opening/closing device according to claim 5, wherein said friction means comprises a fixing pin attached to a side of said a helmet body, an arm member fixed between the fixing pin and said attaching member, and a torque pin attached to said arm member.

7. An opening/closing device according to claim 5, wherein said friction means is said torque pin attached to the side of said a helmet body.

8. An opening/closing device according to claim 6, wherein said torque pin comprises an attaching pin attached to the side of said a helmet body, and a cylindrical portion fittedly installed on an outer circumference of said attaching pin.

9. An opening/closing device according to claim 8, wherein said cylindrical portion is fixed into said attaching pin, so that said cylindrical portion is fittedly installed on said attaching pin.

10. An opening/closing device according to claim 6, wherein one or both sides of said torque pin is/are brought into a press contact with an inner side of said guide grooves, so that said torque pin is fitted into said guide grooves.

11. An opening/closing device according to claim 6, wherein a click stop means using concave portions or convex portions is provided between said guide grooves and said torque pin.

12. An opening/closing device according to claim 1, wherein a stopper means is provided between said shield and said a helmet body for bringing said opening/closing member to stop at a fully-closed position or a fully-opened position with regard to said opened/closed member.

13. An opening/closing device according to claim 5, wherein said a helmet body is a first casing of a portable equipment, and said shield is a second casing.

* * * * *